US006518990B2

(12) United States Patent
Koga et al.

(10) Patent No.: US 6,518,990 B2
(45) Date of Patent: Feb. 11, 2003

(54) IMAGE FORMING APPARATUS FOR FORMING AN ELECTROSTATIC LATENT IMAGE ON A LATENT IMAGE CARRIER

(75) Inventors: Yoshiro Koga, Nagano-ken (JP); Shinichi Kamoshida, Nagano-ken (JP); Kaneo Yoda, Nagano-ken (JP); Nobumasa Abe, Nagano-ken (JP); Yujiro Nomura, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/966,365

(22) Filed: Oct. 1, 2001

(65) Prior Publication Data

US 2002/0041319 A1 Apr. 11, 2002

(30) Foreign Application Priority Data

| | | |
|---|---|---|
| Sep. 29, 2000 | (JP) | 2000-300645 |
| Sep. 29, 2000 | (JP) | 2000-300647 |
| Sep. 29, 2000 | (JP) | 2000-300648 |
| Sep. 29, 2000 | (JP) | 2000-300700 |
| Aug. 8, 2001 | (JP) | 2000-240323 |

(51) Int. Cl.[7] ..... B41J 2/41; B41J 2/395
(52) U.S. Cl. ..... 347/141; 347/147
(58) Field of Search ..... 347/141, 142, 347/143, 144, 145, 146, 147, 148, 149

(56) References Cited

U.S. PATENT DOCUMENTS

| | | | | |
|---|---|---|---|---|
| 4,546,364 A | * | 10/1985 | Todoh | 347/147 |
| 4,607,269 A | * | 8/1986 | Playe | 347/148 |

FOREIGN PATENT DOCUMENTS

| | | | |
|---|---|---|---|
| JP | 63-45104 B2 | 9/1988 | G03G/15/00 |
| JP | 6-166206 | 6/1994 | B41J/2/415 |

* cited by examiner

*Primary Examiner*—Joan Pendegrass
(74) *Attorney, Agent, or Firm*—Sughrue Mion, PLLC

(57) ABSTRACT

In an image forming apparatus of the present invention, a plurality of writing electrodes are supported by an elastic and flexible substrate such that the writing electrodes are aligned in a plurality of rows each extending in the axial direction of the latent image carrier (in the main scanning direction). The writing electrodes are each formed in, for example, a triangle and alternately inverted. In this case, one end of a writing electrode is overlapped with a next writing electrode, as seen in the direction perpendicular to the axial direction of the latent image carrier (the rotational direction of the latent image carrier; the feeding direction). Therefore, this design prevents occurrence of image defect due to linear stains and allows foreign matters adhering to the surface of the latent image carrier to pass through spaces between the adjacent writing electrodes.

12 Claims, 21 Drawing Sheets

(a)

(b)

(c)

(b)

(a)

(c)

(d)

IMAGE FORMING APPARATUS FOR FORMING AN ELECTROSTATIC LATENT IMAGE ON A LATENT IMAGE CARRIER

BACKGROUND OF THE INVENTION

The present invention relates to an image forming apparatus which forms an electrostatic latent image on a latent image carrier by using writing electrodes of a writing device, thereby forming the image.

In a conventional image forming apparatus such as an electrostatic copying machine and a printer, the surface of a photoreceptor (photosensitive member) is uniformly charged by a charging device and the charged surface is then exposed to light from an exposure device such as laser beam or LED light, whereby a latent image is written on the surface of the photoreceptor. Then, the latent image on the surface of the photoreceptor is developed by a developing device to form a developing powder image on the surface of the photoreceptor. The developing powder image is transferred to a receiving medium such as a paper, thereby forming the image.

In such conventional image forming apparatus, the exposure device as a writing device for electrostatic latent image comprises a laser beam generating device or a LED light generating device. Therefore, the entire image forming apparatus should be large and complex.

Therefore, an image forming apparatus has been proposed in Japanese Patent Publication No. S63-45104 (hereinafter, '104B publication) which employs electrodes, as a writing device for forming an electrostatic latent image, to write an electrostatic latent image on a surface of a latent image carrier without using laser beams and LED lights.

The image forming apparatus disclosed in the '104B publication is provided with a multistylus having a large number of needle electrodes. The needle electrodes are just arranged in contact with an inorganic glass layer on the surface of the latent image carrier. In accordance with an input signal for image information, voltages are selectively applied to corresponding ones of the needle electrodes of the multistylus, whereby the electrostatic latent image can be formed on the latent image carrier. Since the image forming apparatus according to the '104B publication does not use an exposure device conventionally used as a writing device, the invention of this publication can provide an image forming apparatus which is relatively small in size and relatively simple in structure.

In addition, an image forming apparatus has been proposed in Japanese Unexamined Patent Publication No. H06-166206 (hereinafter, '206A publication), comprising ion control electrodes which are disposed on a front end portion of an insulating substrate and are arranged in non-contact with a latent image carrier, wherein the ion control electrodes control ions generated by a corona discharger so as to write an electrostatic latent image on the latent image carrier. Since the image forming apparatus according to the '206A publication also does not use an exposure device as a writing device, the invention of this publication can provide an image forming apparatus which is relatively small in size and relatively simple in structure.

However, in the image forming apparatus according to the '104B publication, the large number of needle electrodes of the multistylus are just arranged in contact with the inorganic glass layer on the surface of the latent image carrier. It is difficult to keep the stable contact between the needle electrodes and the inorganic glass layer on the surface of the latent image carrier. Accordingly, it is difficult to stably apply charge to the surface of the latent image carrier. This means that it is hard to obtain a high quality image.

Moreover, it is unavoidable to employ an inorganic glass layer on the surface of the latent image carrier for protecting the surface of the latent image carrier from damage due to contacts of a large number of the needle electrodes. This makes the structure of the latent image carrier more complex. In addition, since the inorganic glass layer has quite well physical adsorbed water characteristic, moisture is easily adsorbed by the surface of the inorganic glass layer. Due to the moisture, the electrical conductivity of the glass surface is increased so that electrostatic charge on the latent image carrier should leak. Therefore, the image forming apparatus should be provided with a means for drying the surface of the latent image carrier with adsorbed moisture in order to prevent the apparatus from being affected by absorbed water. This not only makes the apparatus larger but also increases the number of parts, leading to problems of making the structure further complex and increasing the cost.

Since the large number of needle electrodes discharge, the apparatus has another problem that there is a high possibility of generation of ozone ($O_3$). The presence of ozone may not only produce rusts on parts in the apparatus but also melt resin parts because ozone reacts with $NO_x$ to generate nitrous acid ($HNO_3$). Again ozone may give an offensive smell. Therefore, the image forming apparatus should be provided with an ventilation system including a duct and an ozone filter which sufficiently exhausts ozone from the inside of the apparatus. This also not only makes the apparatus larger but also increases the number of parts, leading to problems of making the structure further complex and increasing the cost.

On the other hand, in the image forming apparatus according to the '206A publication, ions produced by the corona discharger are controlled by the ion control electrodes. This means that the apparatus is structured not to directly inject electric charge to the latent image carrier. The invention of the '206A publication has problems of not only making the image forming apparatus larger and but also making the structure complex. Since the application of charge is conducted by ions, it is difficult to stably write a latent image on the latent image carrier.

Further, since the generation of ions essentially generates ozone, there are problems similar to those described with regard to the image forming apparatus according to '104B publication.

SUMMARY OF THE INVENTION

It is an object of the present invention to provide an image forming apparatus capable of more stably writing an electrostatic latent image and yet achieving reduction in size and reduction in the number of parts thereof so as to have more simple and low-priced structure.

It is another object of the present invention to provide an image forming apparatus capable of further preventing generation of ozone.

In order to achieve these objects, the present invention provides an image forming apparatus which comprises at least: a latent image carrier on which an electrostatic latent image is formed, a writing device for writing said electrostatic latent image on said latent image carrier, and a developing device for developing said electrostatic latent image on the latent image carrier, wherein said electrostatic latent image, written on said latent image carrier by said writing device, is developed by said developing device, thereby forming an image, and is characterized in that said writing device has a plurality of writing electrodes for writing said electrostatic latent image on said latent image carrier and a substrate for supporting said writing electrodes, and that said plurality of writing electrodes are aligned in the main scanning direction of said latent image carrier.

The present invention is characterized in that said writing electrodes are aligned in a single row extending in the main scanning direction of said latent image carrier.

The present invention is further characterized in that said writing electrodes are arranged such that a portion of one writing electrode is overlapped with a portion of a writing electrode, next to the one writing electrode, as seen in the feeding direction of said latent image carrier.

The present invention is still characterized in that said writing electrodes are each formed in a triangle, a parallelogram, or a trapezoid.

Further, the present invention is characterized in that said writing electrodes are each formed in a triangle or a trapezoid and the writing electrodes are arranged in such a manner that the orientations of the triangles or trapezoids of the writing electrodes are alternately inverted.

Furthermore, the present invention is characterized in that said writing electrodes are each formed in a circle, an oval, an ellipse, a rectangle, a square, a pentagon, a polygon having 6 or more corners, or a polygon with rounded corners.

The present invention is characterized in that said writing electrodes are aligned in a plurality of rows each extending in the main scanning direction of said latent image carrier, wherein the rows are arranged in parallel with each other in the feeding direction of said latent image carrier.

The present invention is further characterized in that the number of the parallel rows each extending in the main scanning direction is two and said writing electrodes are arranged in zigzag fashion such that a writing electrode in one row is placed at a position corresponding to a position between two adjacent writing electrodes in the other row while a writing electrode in the other row is placed at a position corresponding to a position between two adjacent writing electrodes in said one row.

Further, the present invention is characterized in that at least said writing electrodes are coated with protecting layers.

Furthermore the present invention is characterized in that at least a portion of each said writing electrode confronting said latent image carrier is made of material easily to wear.

In the image forming apparatus of the present invention having the aforementioned structure, a plurality of writing electrodes are aligned in the main scanning direction of a latent image carrier, thereby making a simple array pattern (electrode pattern) and ensuring an image formation region.

In addition, the writing electrodes are supported by a flexible substrate, thereby stabilizing the positions of the writing electrodes relative to the latent image carrier and thus stably and reliably conducting the application or removal of charge by the writing electrodes relative to the latent image carrier. Therefore, stable writing of an electrostatic latent image is achieved, thus reliably obtaining a high quality image with high precision.

Since the writing electrodes can be securely kept in contact with the latent image carrier with a small pressing force by the flexible substrate or securely kept in proximity to the latent image carrier, the gap (space) between the writing electrodes and the latent image carrier can be extremely reduced. The reduced gap practically reduces the possibility that air existing in the gap is undesirably ionized, thereby further reducing the generation of ozone and enabling the formation of an electrostatic latent image with low potential. In addition, the latent image carrier can be prevented from being damaged by the writing electrodes, thus improving the durability of the latent image carrier.

Further, since the writing device employs only the writing electrodes without using a laser beam generating device or a LED light generating device which is large in size as conventionally used, the apparatus size can be reduced and the number of parts can also be reduced, thereby obtaining an image forming apparatus which is simple and low-price.

The writing electrodes which aligned just in a single row extending in the main scanning direction, thereby making a simple array pattern (electrode pattern) and ensuring an image formation region.

Further, every pair of adjacent writing electrodes which are next to each other are partially overlapped with each other as seen in the feeding direction of the latent image carrier, thereby eliminating such portions in the surface of the latent image carrier that are not subjected to the application or removal of charge and thus achieving uniform application or removal of charge relative to the entire surface of the latent image carrier. Therefore, the occurrence of image defect due to linear stains can be prevented.

The writing electrodes are each formed in a triangle, a parallelogram, or a trapezoid, thereby allowing foreign matters adhering to the surface of the latent image carrier to smoothly and easily pass through spaces between adjacent writing electrodes because the foreign matters can be guided by oblique sides of the triangles, parallelograms, or trapezoids.

Further, the triangular or trapezoidal writing electrodes are arranged in such a manner that the orientations of the triangles or trapezoids of the writing electrodes are alternately inverted. This arrangement enables the triangular or trapezoidal writing electrodes to be efficiently aligned in a compact form in the main scanning direction. This arrangement of alternately inverting the orientations of the triangular or trapezoidal writing electrodes ensures the adjacent writing electrodes to be efficiently partially overlapped with each other in the feeding direction, thereby efficiently and securely exhibiting the effect of overlapping mentioned above.

Furthermore, since the writing electrode can be formed in a circle, an oval, an ellipse, a rectangle, a square, a pentagon, a polygon having 6 or more corners, or a polygon with rounded corners, the writing electrode is flexible to be employed in various types of image forming apparatuses using writing electrodes. In particular, by rounding off corners of a polygon of the writing electrode to eliminate sharp angled portions (edges), the discharge between adjacent writing electrodes can be prevented.

The writing electrodes are aligned in a plurality of parallel rows each extending in the main scanning direction, thereby ensuring the adjacent writing electrodes to be efficiently partially overlapped with each other in the feeding direction, thereby efficiently and securely exhibiting the effect of overlapping mentioned above. In particular, according to the invention defined in claim 8, the writing electrodes are aligned in two parallel rows each extending in the main scanning direction, thus making the arrangement of the writing electrodes more simple, and the writing electrodes in the first and second rows are arranged in a zigzag fashion, thereby easily arranging the writing electrodes while overlapping portions thereof.

Moreover, at least the writing electrodes are coated with the protective layers. The protective layers prevent wear of the writing electrodes and making foreign matters difficult to adhere to the writing electrodes.

In addition, since the portion of the writing electrode confronting the latent image carrier is made of material easily to wear, the portion is shaved by the contact the surface of the writing electrodes relative to the latent image carrier to have a fresh surface so that the surface of the writing electrode can be kept fresh, thus preventing the filming of the writing electrode.

Still other objects and advantages of the invention will in part be obvious and will in part be apparent from the specification.

The invention accordingly comprises the features of construction, combinations of elements, and arrangement of parts which will be exemplified in the construction hereinafter set forth, and the scope of the invention will be indicated in the claims.

DESCRIPTION OF THE PREFERRED EMBODIMENTS

The embodiments of the present invention will be described hereinafter with reference to the drawings.

Figure 1:
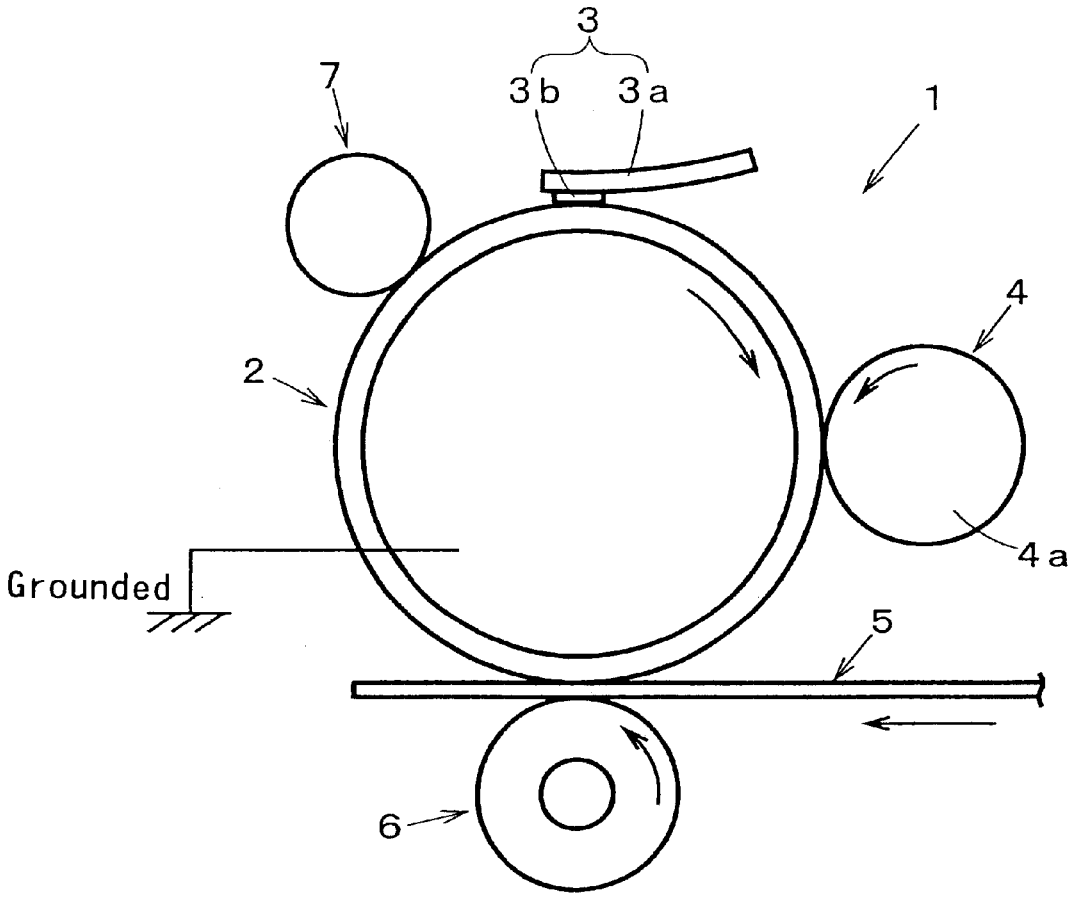
FIG. 1 is a schematic illustration of the basic structure of an image forming apparatus in accordance with the present invention.

FIG. 1 is a schematic illustration of the basic structure of an image forming apparatus in accordance with the present invention.

As shown in FIG. 1, an image forming apparatus 1 according to the present invention comprises, at least, a latent image carrier 2 on which an electrostatic latent image is formed, a writing device 3 (hereinafter, sometimes referred to as "writing head" ) which is arranged in contact with the latent image carrier 2 to write the electrostatic latent image on the latent image carrier 2, a developing device 4 which develops the electrostatic latent image on the latent image carrier 2 with developing powder carried and conveyed by a developing powder carrier 4*a* (developing roller), a transferring device 6 which transfers a developing powder image on the latent image carrier 2, developed by the developing device 4, to a receiving medium 5 such as a paper, and a charge control device 7 which makes the surface of the latent image carrier 2 into the uniformly charged state by removing any residual charge from the latent image carrier 2 after the transfer of the latent image or by charging (i.e. applying charge to) the latent image carrier 2 after the transfer of the electrostatic latent image.

Though the following description will be made assuming that the latent image carrier 2 is grounded, this is for the purpose of facilitating the description only and not of limitation. That is, the latent image carrier 2 may not be grounded.

The writing head 3 comprises a flexible substrate 3a (in the following description, sometimes referred to as "supporting substrate"), having high insulation property and being relatively soft and elastic, such as a FPC (Flexible Print Circuit: hereinafter, referred to as "FPC") or a PET (polyethylene terephthalate: hereinafter, referred to as "PET"), and writing electrodes 3*b* which are supported by the substrate 3*a* and which are pressed lightly against the latent image carrier 2 with weak elastic restoring force created by deflection of the substrate 3*a* so that the writing electrodes 3*b* are in contact with the latent image carrier 2 so as to write the electrostatic latent image.

In the image forming apparatus 1 having a structure as mentioned above, after the surface of the latent image carrier 2 is made into the uniformly charged state by the charge control device 7, an electrostatic latent image is written on the uniformly charged surface of the latent image carrier 2 by the writing device 3 which is in contact with the latent image carrier 2. Then, the electrostatic latent image on the latent image carrier 2 is developed with developing powder of the developing device 4 to form a developing powder image and the developing powder image is transferred to the receiving medium 5 by the transferring device 6. It should be noted that the uniformly charged state includes a state where there is neither positive (+) charge nor negative (−) charge i.e. no charge is uniformly applied to the latent image carrier 2 by removing charge from the latent image carrier 2.

Figure 2:
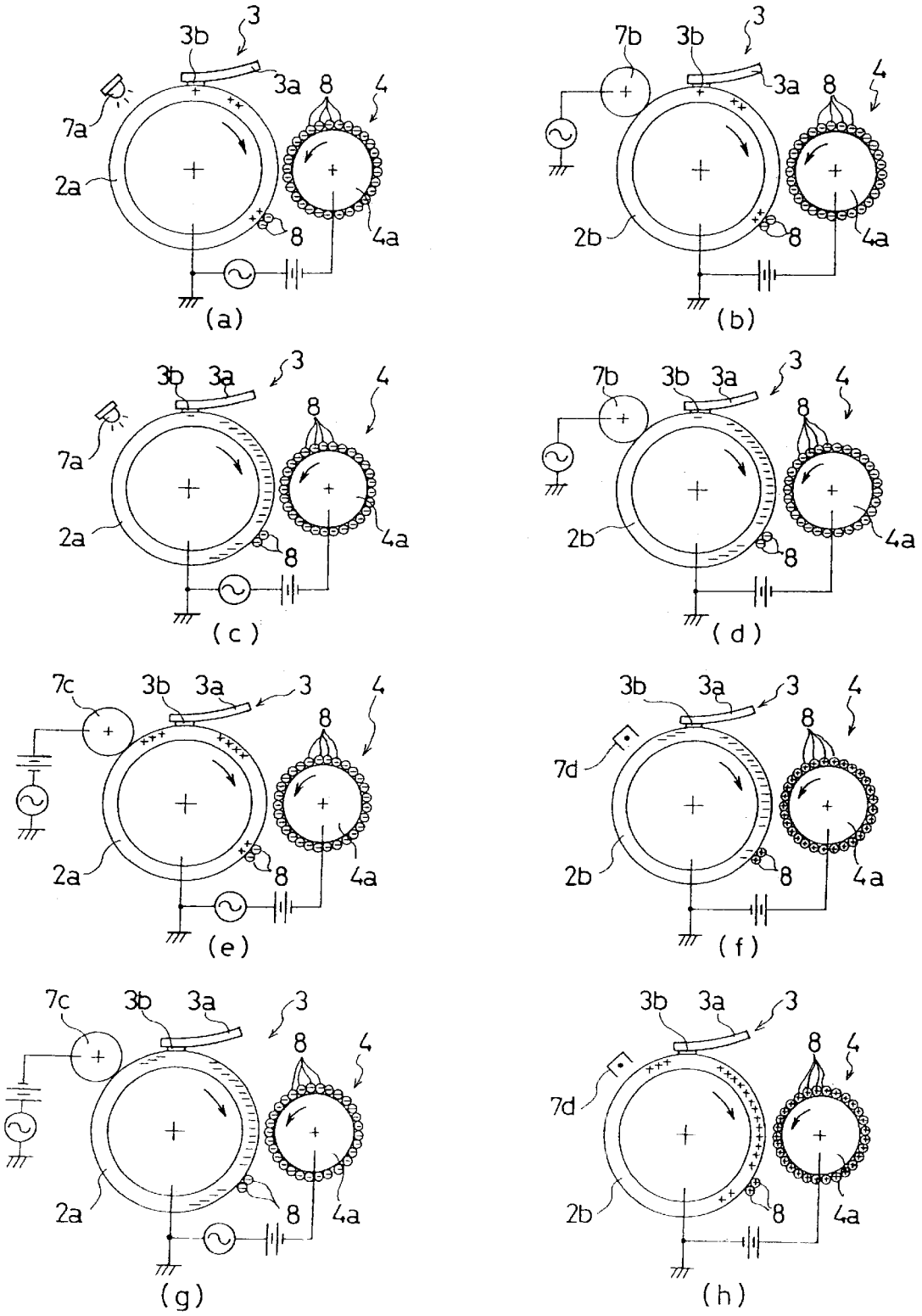
FIG. 2, parts (*a*)–(*h*) are views each illustrating an example of the basic process of forming an image in the image forming apparatus of the present invention.

FIGS. 2(*a*)–2(*h*) are views each illustrating an example of the basic process of forming an image in the image forming apparatus 1 of the present invention.

As the basic process of forming an image in the image forming apparatus 1 of the present invention, there are four types as follows: (1) making uniformly charged state by removal of charge—writing by contact application of charge—normal developing; (2) making uniformly charged state by removal of charge—writing by contact application of charge—reversal developing; (3) making uniformly charged state by application of charge—writing by contact removal of charge—normal developing; and (4) making uniformly charged state by application of charge—writing by contact removal of charge—reversal developing.

(1) Making Uniformly Charged State by Removal of Charge—Writing by Contact Application of Charge—Normal Developing A process illustrated in FIG. 2(*a*) is an example of this image forming process. As shown in FIG. 2(*a*), in this example, a photoreceptor 2*a* is employed as the latent image carrier 2 and a charge removing lump 7*a* is employed as the charge control device 7. The electrodes 3*b* of the writing device 3 are in contact with the photoreceptor 2*a* so that positive (+) charge is mainly transferred (that is, injected) from the writing electrodes 3*b* to image portions of the photoreceptor 2*a*, whereby the image portions of the photoreceptor 2*a* are positively (+) charged. In this way, an electrostatic latent image is written on the photoreceptor 2*a*. In addition, a bias voltage composed of an alternating current superimposed on a direct current of a negative (−) polarity is applied to the developing powder carrier 4*a* such as an image developing roll of the developing device 4, as in conventional ones. Accordingly, the developing powder carrier 4*a* conveys negatively (−) charged developing powder 8 to the photoreceptor 2*a*. It should be noted that a bias voltage composed only of a direct current of a negative (−) polarity may be applied to the developing powder carrier 4*a*.

In the image forming process of this example, the charge removing lump 7*a* removes charge from the surface of the photoreceptor 2*a* to make the surface into the uniformly charged state with nearly 0V (zero volt) and, after that, the image portions of the photoreceptor 2*a* are positively (+) charged by the writing electrodes 3*b* of the writing device 3, thereby writing an electrostatic latent image onto the photoreceptor 2*a*. Then, negatively (−) charged developing powder 8 conveyed by the developing powder carrier 4*a* of the developing device 4 adheres to the positively (+) charged image portions of the photoreceptor 2*a*, thereby normally developing the electrostatic latent image.

A process illustrated in FIG. 2(*b*) is another example of this image forming process. As shown in FIG. 2(*b*), in this example, a dielectric body 2*b* is employed as the latent image carrier 2 and a charge removing roller 7*b* is employed as the charge control device 7. As in conventional ones, a bias voltage composed of a direct current of a negative (−) polarity may be applied to the developing powder carrier 4*a* of the developing device 4. It should be noted that a bias voltage composed of an alternating current superimposed on a direct current of a negative (−) polarity may be applied to the developing powder carrier 4*a*. On the other hand, a bias voltage composed of an alternating current is applied to the charge removing roller 7*b*. Other structures of this example are the same as those of the aforementioned example shown in FIG. 2(*a*).

In the image forming process of this example, the charge removing roller 7*b* is in contact with the dielectric body 2*b* so as to remove charge from the surface of the dielectric body 2*b* to make the surface into the uniformly charged state with nearly 0V (zero volt). The image forming actions after that are the same as those of the aforementioned example shown in FIG. 2(*a*), except that the dielectric body 2*b* is used instead of the photoreceptor 2*a*.

(2) Making Uniformly Charged State by Removal of Charge—Writing by Contact Application of Charge—Reversal Developing A process shown in FIG. 2(*c*) is an example of this image forming process. As shown in FIG. 2(*c*), in this example, a photoreceptor 2*a* is employed as the latent image carrier 2 and a charge removing lump 7*a* is employed as the charge control device 7 just like the example shown in FIG. 2(*a*). The writing electrodes 3*b* of the writing device 3 are in contact with the photoreceptor 2*a* so that negative (−) charge is mainly transferred (that is, injected) from the writing electrodes 3*b* to non-image portions of the photoreceptor 2*a*, whereby the non-image portions of the photoreceptor 2*a* are negatively (−) charged. Other structures of this example are the same as those of the aforementioned example shown in FIG. 2(*a*).

In the image forming process of this example, the charge removing lamp 7*a* removes charge from the surface of the photoreceptor 2*a* to make the surface into the uniformly charged state with nearly 0V (zero volt) and, after that, the non-image portions of the photoreceptor 2*a* are negatively (−) charged by the writing electrodes 3*b* of the writing device 3, thereby writing an electrostatic latent image onto the photoreceptor 2*a*. Then, negatively (−) charged developing powder 8 conveyed by the developing powder carrier 4*a* of the developing device 4 adheres to portions, not negatively (−) charged and having nearly 0V (zero volt), of the photoreceptor 2*a*, thereby reversely developing electrostatic latent image.

A process illustrated in FIG. 2(*d*) is another example of this image forming process. As shown in FIG. 2(*d*), in this example, a dielectric body 2*b* is employed as the latent image carrier 2 and a charge removing roller 7*b* is employed as the charge control device 7 just like the example shown in FIG. 2(*b*). The writing electrodes 3*b* of the writing device 3 are arranged in contact with the dielectric body 2*b* to negatively (−) charge non-image portions of the dielectric body 2*b*. Other structures of this example are the same as those of the aforementioned example shown in FIG. 2(*b*).

In the image forming process of this example, the charge removing roller 7*b* is in contact with the dielectric body 2*b* so as to remove charge from the surface of the dielectric body 2*b* to make the surface into the uniformly charged state with nearly 0V (zero volt). The image forming actions after that are the same as those of the aforementioned example shown in FIG. 2(*c*), except that the dielectric body 2*b* is used instead of the photoreceptor 2*a*.

(3) Making Uniformly Charged State by Application of Charge—Writing by Contact Removal of Charge—Normal Developing A process shown in FIG. 2(*e*) is an example of this image forming process. As shown in FIG. 2(*e*), in this example, a photoreceptor 2*a* is employed as the latent image carrier 2 and a charging roller 7*c* is employed as the charge control device 7. A bias voltage composed of an alternating current superimposed on a direct current of a positive (+) polarity is applied to the charging roller 7*c* so that the charging roller 7*c* uniformly positively (+) charges the surface of the photoreceptor 2*a*. It should be noted that a bias voltage composed only of a direct current of a positive (+) polarity may be applied to the charging roller 7*c*. In addition, the writing electrodes 3*b* of the writing device 3 are in contact with the photoreceptor 2*a* so that positive (+) charge is mainly transferred (that is, extracted) from the non-image portions of the photoreceptor 2*a* to the writing electrodes 3*b*, whereby positive (+) charge is removed from the non-image portions of the photoreceptor 2*a*. Other structures of this example are the same as those of the aforementioned example shown in FIG. 2(*a*).

In the image forming process of this example, the charging roller 7*c* is arranged in contact with the photoreceptor 2*a* to positively (+) charge the surface of the photoreceptor 2*a* to make the surface into the uniformly charged state with a predetermined voltage and, after that, positive (+) charge is removed from the non-image portions of the photoreceptor 2*a* by the writing electrodes 3*b* of the writing device 3, thereby writing an electrostatic latent image onto the photoreceptor 2*a*. Then, negatively (−) charged developing powder 8 conveyed by the developing powder carrier 4*a* of the developing device 4 adheres to the image portions, positively (+) charged, of the photoreceptor 2*a*, thereby normally developing the electrostatic latent image.

A process illustrated in FIG. 2(*f*) is another example of this image forming process. As shown in FIG. 2(*f*), in this example, a dielectric body 2*b* is employed as the latent image carrier 2 and a corona charging device 7*d* is employed as the charge control device 7. A bias voltage composed of a direct current of a negative (−) polarity or a bias voltage composed of an alternating current superimposed on a direct current of a negative (−) polarity is applied to the corona charging device 7*d*, but not illustrated. The writing electrodes 3*b* of the writing device 3 are arranged in contact with the dielectric body 2*b* to remove negative (−) charge from the non-image portions of the dielectric body 2*b*. Moreover, a bias voltage composed of a direct current of a positive (+) polarity is applied to the developing powder carrier 4*a* so that the developing powder carrier 4*a* conveys positively (+) charged developing powder 8 to the dielectric body 2*b*. It should be noted that a bias voltage composed of an alternating current superimposed on a direct current of a positive (+) polarity may be applied to the developing powder carrier 4*a*. Other structures of this example are the same as those of the aforementioned example shown in FIG. 2(*b*).

In the image forming process of this example, the surface of the dielectric body 2*b* is negatively (charged by the corona charging device 7*d* to make the surface of the dielectric body 2*b* into the uniformly charged state with the predetermined voltage and, after that, negative (−) charge is removed from the non-image portions of the dielectric body 2*b* by the writing electrodes 3*b* of the writing device 3, thereby writing an electrostatic latent image on the dielectric body 2*b*. Then, positively (+) charged developing powder 8 conveyed by the developing powder carrier 4*a* of the developing device 4 adheres to the image portions, negatively (−) charged, of the dielectric body 2*b*, thereby normally developing the electrostatic latent image.

(4) Making Uniformly Charged State by Application of Charge—Writing by Contact Removal of Charge—Reversal Developing A process shown in FIG. 2(*g*) is an example of this image forming process. As shown in FIG. 2(*g*), in this example, a photoreceptor 2*a* is employed as the latent image carrier 2 and a charging roller 7*c* is employed as the charge control device 7. A bias voltage composed of an alternating current superimposed on a direct current of a negative (−) polarity is applied to the charging roller 7*c* so that the charging roller 7*c* uniformly negatively (−) charges the surface of the photoreceptor 2*a*. It should be noted that a bias voltage composed only of a direct current of a negative (−) polarity may be applied to the charging roller 7*c*. The writing electrodes 3*b* of the writing device 3 are in contact with the photoreceptor 2*a* so that negative (−) charge is transferred (that is, extracted) from the image portions of the photoreceptor 2*a* to the writing electrodes 3*b*, whereby negative (−) charge is removed from the image portions of the photoreceptor 2*a*. Other structures of this example are the same as those of the aforementioned example shown in FIG. 2(*a*).

In the image forming process of this example, the charging roller 7*c* is arranged in contact with the photoreceptor 2*a* to negatively (−) charge the surface of the photoreceptor 2*a* to make the surface into the uniformly charged state with a predetermined voltage and, after that, negative (−) charge is removed from the image portions of the photoreceptor 2*a* by the writing electrodes 3*b* of the writing device 3, thereby writing an electrostatic latent image onto the photoreceptor 2*a*. Then, negatively (−) charged developing powder 8 conveyed by the developing roller 4*a* of the developing device 4 adheres to the image portions, not negatively (−) charged, of the photoreceptor 2*a*, thereby reversely developing the electrostatic latent image.

A process illustrated in FIG. 2(*h*) is another example of this image forming process. As shown in FIG. 2(*h*), in this example, a dielectric body 2*b* is employed as the latent image carrier 2 and a corona charging device 7*d* is employed as the charge control device 7. A bias voltage composed of a direct current of a positive (+) polarity or a bias voltage composed of an alternating current superimposed on a direct current of a positive (+) polarity is applied to the corona charging device 7*d*, but not illustrated. Other structures of this example are the same as those of the aforementioned example shown in FIG. 2(*f*).

In the image forming process of this example, the surface of the dielectric body 2*b* is positively (+) charged by the corona charging device 7*d* to make the surface of the dielectric body 2*b* into the uniformly charged state with the predetermined voltage and, after that, positive (+) charge is removed from the image portions of the dielectric body 2*b* by the writing electrodes 3*b* of the writing device 3, thereby writing an electrostatic latent image onto the dielectric body 2*b*. Then, positively (+) charged developing powder 8 conveyed by the developing roller 4*a* of the developing device 4 adheres to the image portions, not positively (+) charged, of the dielectric body 2*b*, thereby reversely developing the electrostatic latent image.

Figure 3:
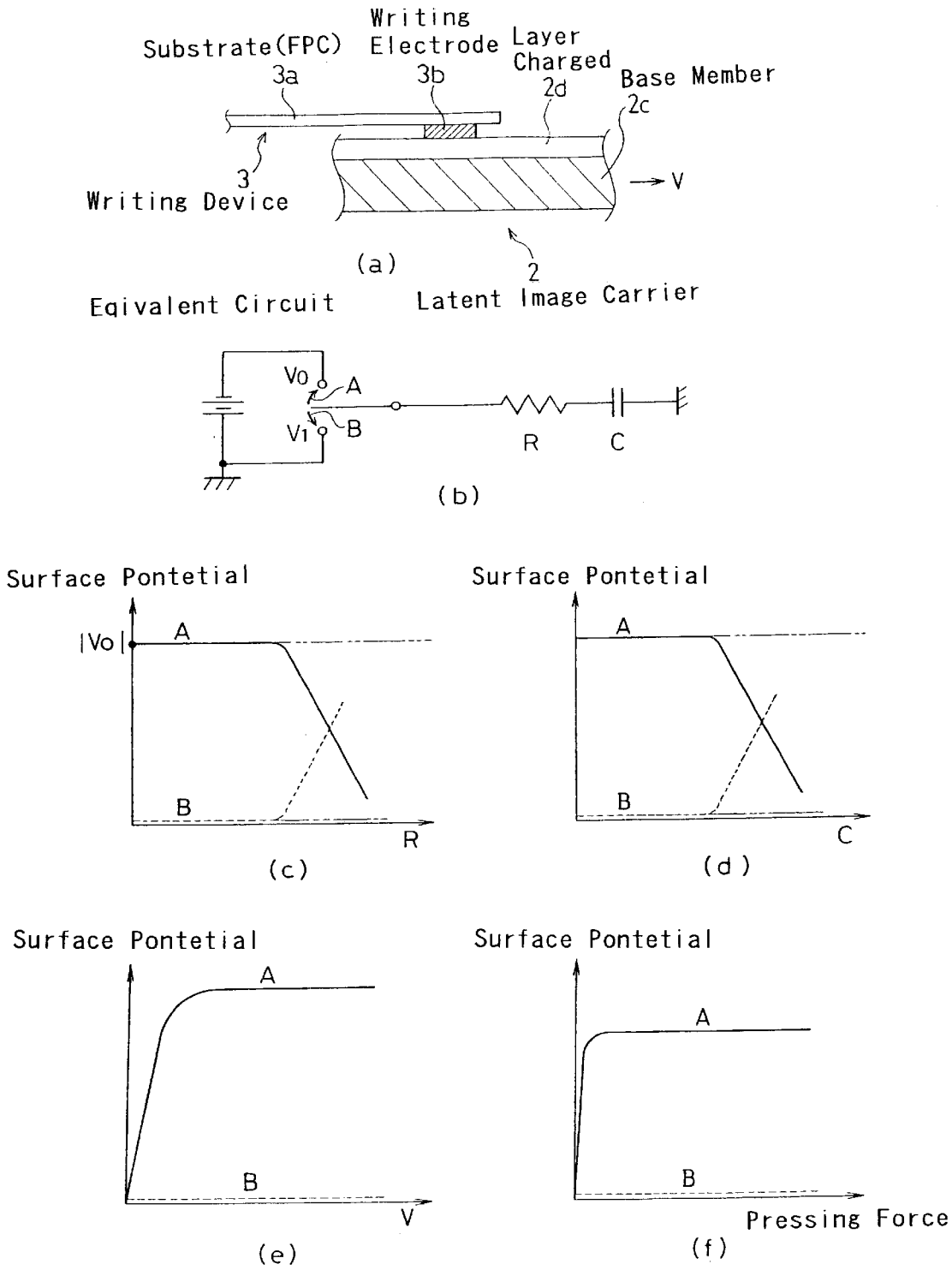
FIG. 3, parts (*a*)–(*f*) are views for explaining the principle of writing an electrostatic latent image by writing electrodes of a writing device through application or removal of charge, wherein part (*a*) is an enlarged view of a portion where a writing electrode is in contact with the latent image carrier, part (*b*) is a diagram of an electrical equivalent circuit of the contact portion, and parts (*c*)–(*f*) are graphs each showing the relation between each parameter and the surface potential of the latent image carrier.

FIGS. 3(*a*)–3(*f*) are views for explaining the principle of writing an electrostatic latent image by the writing electrodes 3*b* of the writing device 3 through application or removal of charge, wherein FIG. 3(*a*) is an enlarged view of a contact portion where a writing electrode 3*b* is in contact with the latent image carrier 2, FIG. 3(*b*) is a diagram of an electrical equivalent circuit of the contact portion, and FIGS. 3(*c*)–3(*f*) are graphs each showing the relation between each parameter and the surface potential of the latent image carrier 2.

As shown in FIG. 3(*a*), the latent image carrier 2 comprises a base member 2*c* which is made of a conductive material such as aluminum and is grounded and an insulating charged layer 2d formed on the outer periphery of the base member 2*c*. The writing electrodes 3*b* supported by the substrate 3*a* made of FPC or the like of the writing device 3 are in contact with the charged layer 2*d* with a predetermined small pressing force and the latent image carrier 2 travels (rotates) at a predetermined speed "v". As the aforementioned small pressing force, 10N or less per 300 mm in width, that is, a linear load of 0.03 N/mm or less is preferable for stabilizing the contact between the writing electrodes 3*b* and the latent image carrier 2 or the proximity of the writing electrodes 3*b* to the latent image carrier 2 (keeping the space between the writing electrodes 3*b* and the latent image carrier 2 constant) and for stabilizing the charge-transfer by the contact or charge-transfer by discharge of the writing electrodes. In view of abrasion, it is preferable to achieve the smallest possible linear load while keeping the contact stability.

Either of a predetermined high voltage $V_0$ and a predetermined low voltage $V_1$ is selectively impressed to the writing electrodes 3*b* through the substrate 3*a* (as mentioned, since there are positive and negative charges, the high voltage is a voltage having a high absolute value and the low voltage is a voltage of the same polarity as the high voltage and having a low absolute value or 0V (zero volt). In the description of the present invention in this specification, the low voltage is a ground voltage. In the following description, therefore, the high voltage $V_0$ is referred to as the predetermined voltage $V_0$ and the low voltage $V_1$ is referred to as the ground voltage $V_1$. It should be understood that the ground voltage $V_1$ is 0V (zero volt.)

That is, the contact portion (nip) between each writing electrode 3*b* and the latent image carrier 2 is provided with an electrical equivalent circuit shown in FIG. 3(*b*). In FIG. 3(*b*), "R" designates the resistance of the writing electrode 3*b* and "C" designates the capacity of the latent image carrier 2. The resistance R of the writing electrode 3*b* is selectively switched to be connected to the A side of the predetermined voltage $V_0$ of a negative (−) polarity or to the B side of the ground voltage $V_1$.

FIG. 3(*c*) shows the relation between the resistance R of the writing electrode 3*b* and the surface potential of the latent image carrier 2. The aforementioned relation when the writing electrode 3*b* is connected to the A side in the electrical equivalent circuit to impress the predetermined voltage $V_0$ of a negative (−) polarity to the writing electrode 3*b* is represented by a solid line in FIG. 3(*c*). As shown by the solid line in FIG. 3(*c*), the surface potential of the latent image carrier 2 is constant at the predetermined voltage $V_0$ in a region where the resistance R of the writing electrode 3*b* is small, and the absolute value of the surface potential of the latent image carrier 2 decreases in a region where the resistance R of the writing electrode 3*b* is greater than a predetermined value. On the other hand the relation between the resistance R of the writing electrode 3*b* and the surface potential of the latent image carrier 2 when the writing electrode 3*b* is connected to the B side to ground the electrode 3*b* is represented by a dotted line in FIG. 3(*c*). As shown by the dotted line in FIG. 3(*c*), the surface potential of the latent image carrier 2 is constant at substantially the ground voltage $V_1$ in a region where the resistance R of the writing electrode 3*b* is small, and the absolute value of the surface potential of the latent image carrier 2 increases in a region where the resistance R of the writing electrode 3*b* is greater than the predetermined value.

Figure 4:
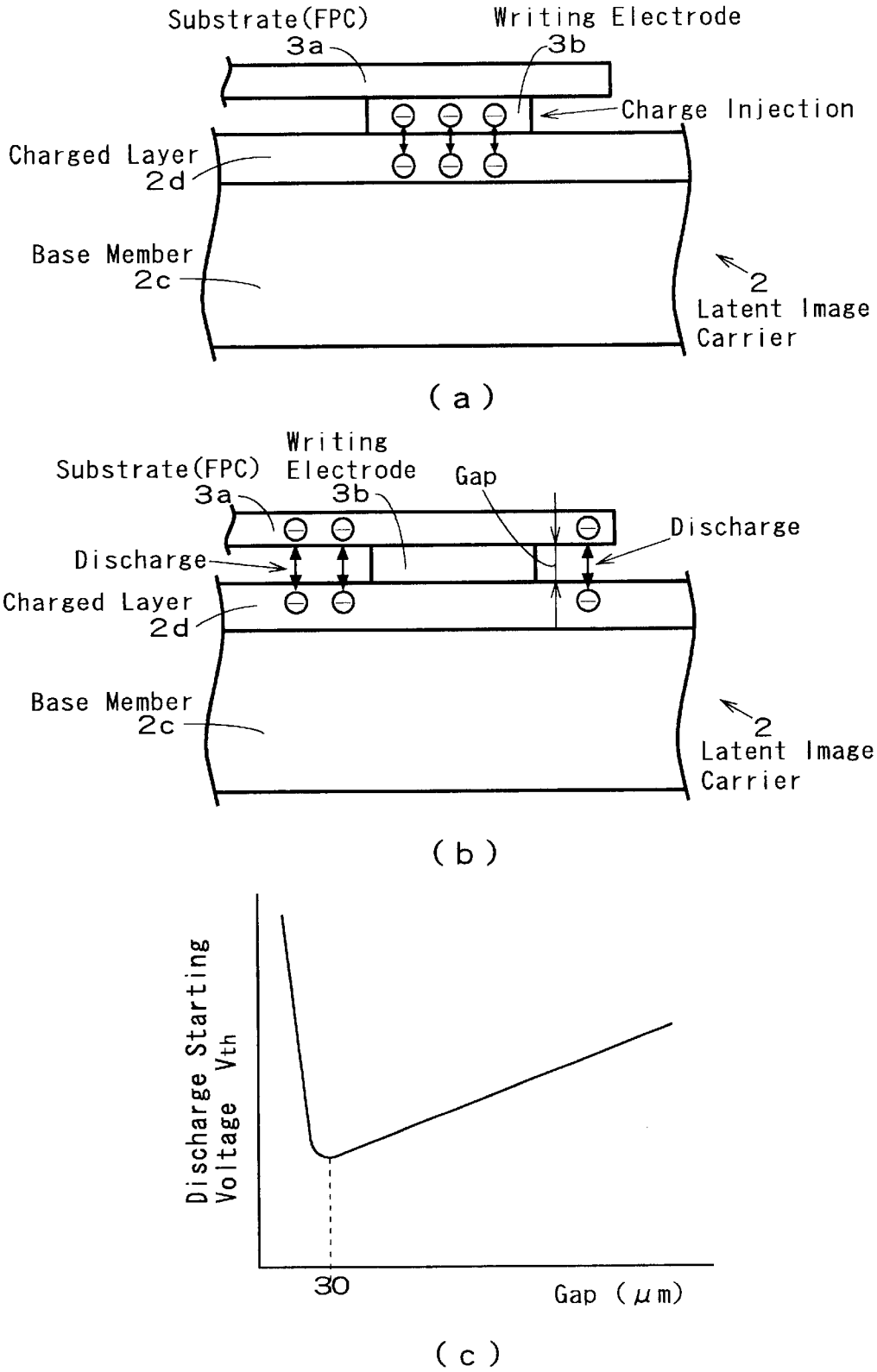
FIG. 4, parts (*a*)–(*c*) are views for explaining the application or removal of charge relative to the latent image carrier, wherein part (*a*) is a view for explaining the application or rem oval of charge relative to the latent image carrier via the charge-transfer, part (*b*) is a view for explaining the application or removal of charge relative to the latent image carrier via the discharge, and part (*c*) is a graph for explaining Paschen's law.

In the region where the resistance R of the writing electrode 3*b* is small and the surface potential of the latent image carrier 2 is constant at the predetermined voltage $V_0$ or constant at the ground voltage $V_1$, negative (−) charge directly moves from a lower voltage side to a higher voltage side, that is, the charge-transfer is conducted between the writing electrode 3*b* being in contact with the latent image carrier 2 and the charged layer 2*d* of the latent image carrier 2, as shown in FIG. 4(*a*). This means that charge is applied to or removed from the latent image carrier 2 via the charge-transfer. In the region where the resistance R of the writing electrode 3*b* is great and the surface potential of the latent image carrier 2 starts to vary, the application or removal of charge relative to the latent image carrier 2 via the charge-transfer is gradually reduced and discharge occurs between the substrate 3*a* and the base member 2*c* of the latent image carrier 2 as shown in FIG. 4(*b*) as the resistance R of the writing electrode 3*b* is increased.

The discharge between the substrate 3*a* and the base member 2*c* of the latent image carrier 2 occurs when the absolute value of the voltage, (the predetermined voltage $V_0$) between the substrate 3*a* and the latent image carrier 2 becomes higher than a discharge starting voltage $V_{th}$. The relation between the gap, between the substrate 3*a* and the latent image carrier 2, and the discharge starting voltage $V_{th}$ is just as shown in FIG. 4(*c*), according to Paschen's law. That is, the discharge starting voltage $V_{th}$ is the lowest when the gap is about 30 $\mu$m, so the discharge starting voltage $V_{th}$ should be high when the gap is either larger or smaller than about 30 $\mu$m, making the occurrence of discharge difficult. Even via the discharge, charge can be applied to or removed from the surface of the latent image carrier 2. However, when the resistance R of the writing electrode 3*b* is in this region, the application or removal of charge relative to the latent image carrier 2 via the charge-transfer is greater while the application or removal of charge relative to the latent image carrier 2 via the discharge is smaller. This means that the application or removal of charge relative to the latent image carrier 2 is dominated by the application or removal of charge via the charge-transfer. By the application or removal of charge via the charge-transfer, the surface potential of the latent image carrier 2 becomes to the predetermined voltage $V_0$ to be impressed to the writing electrode 3*d* or the ground voltage $V_1$. In case of the application of charge via the charge-transfer, the predetermined voltage $V_0$ to be supplied to the writing electrode 3*b* is preferably set to a voltage equal to or less than the discharge starting voltage $V_{th}$ at which the discharge occurs between the writing electrode 3*b* and the latent image carrier 2.

When the resistance R of the writing electrode 3*b* is greater than the region, the application or removal of charge relative to the latent image carrier 2 via the charge-transfer is smaller while the application or removal of charge relative to the latent image carrier 2 via the discharge is greater than that via the charge-transfer. The application or removal of charge relative to the latent image carrier 2 gradually becomes dominated by the application or removal of charge via the discharge. That is, as the resistance R of the writing electrode 3*b* becomes greater, the application or removal of charge relative to the surface of the latent image carrier 2 is performed mainly via the discharge and rarely via the charge-transfer. By the application or removal of charge via the discharge, the surface potential of the latent image carrier 2 becomes to a voltage obtained by subtracting the discharge starting voltage $V_{th}$ from the predetermined voltage $V_0$ to be impressed to the writing electrode 3*d* or the ground voltage $V_1$. It should be noted that the same is true when the predetermined voltage $V_0$ is of a positive (+) polarity.

Therefore, the application or removal of charge relative to the latent image carrier 2 via the charge-transfer can be achieved by satisfying a condition that the resistance R of the electrode 3*b* is set in such a small range as to allow the surface potential of the latent image carrier 2 to be constant at the predetermined voltage $|V_0|$ (this is an absolute value because voltages of opposite (±) polarities are available) or constant at the ground voltage $V_1$ and by controlling the voltage to be impressed to the writing electrode 3*b* to be switched between the predetermined voltage $V_0$ and the ground $V_1$.

FIG. 3(*d*) shows the relation between the capacity C of the latent image carrier 2 and the surface potential of the latent image carrier 2. The aforementioned relation when the writing electrode 3*b* is connected to the A side to impress the predetermined voltage $V_0$ of a negative (−) polarity to the writing electrode 3*b* is represented by a solid line in FIG. 3(*d*). As shown by the solid line in FIG. 3(*d*), the surface potential of the latent image carrier 2 is constant at the predetermined voltage $V_0$ in a region where the capacity C of the latent image carrier 2 is small, and the absolute value of the surface potential of the latent image carrier 2 decreases in a region where the capacity C of the latent image carrier 2 is larger than a predetermined value. On the other hand, the relation between the capacity C of the latent image carrier 2 and the surface potential of the latent image carrier 2 when the writing electrode 3*b* is connected to the B side to ground the writing electrode 3*b* is represented by a dotted line in FIG. 3(*d*). As shown by the dotted line in FIG. 3(*d*), the surface potential of the latent image carrier 2 is constant at substantially the ground voltage $V_1$ in a region where the capacity C of the latent image carrier 2 is small, and their absolute value of the surface potential of the latent image carrier 2 increases in a region where the capacity C of the latent image carrier 2 is larger than a predetermined value.

In the region where the capacity C of the latent image carrier 2 is small and the surface potential of the latent image carrier 2 is constant at the predetermined voltage $V_0$ or constant at the ground voltage $V_1$, negative (−) charge is directly transferred between the writing electrode 3*b* being in contact with the latent image carrier 2 and the charged layer 2*d* of the latent image carrier 2. That is, charge is applied to or removed from the latent image carrier 2 via the charge-transfer. In the region where the capacity C of the latent image carrier 2 is large and the surface potential of the latent image carrier 2 starts to vary, the application or removal of charge relative to the latent image carrier 2 via the charge-transfer is gradually reduced and discharge is started between the substrate 3*a* and the base member 2*c* of the latent image carrier 2 as shown in FIG. 4(*b*) as the capacity C of the latent image carrier 2 is increased. Even via the discharge, charge can be applied to or removed from the surface of the latent image carrier 2. However, when the capacity C of the latent image carrier 2 is in this region, the application or removal of charge relative to the latent image carrier 2 via the charge-transfer is greater while the application or removal of charge relative to the latent image carrier 2 via the discharge is smaller. This means that the application or removal of charge relative to the latent image carrier 2 is dominated by the application or removal of charge via the charge-transfer. By the application or removal of charge via the charge-transfer, the surface potential of the latent image carrier 2 becomes to the predetermined voltage $V_0$ to be impressed to the writing electrode 3*d* or the ground voltage $V_1$.

When the capacity C of the latent image carrier 2 is greater than the region, there is now little charge-transfer between the writing electrode 3*b* and the charged layer 2*d* of the latent image carrier 2. This means that little or no charge is applied to or removed from the latent image carrier 2 via the charge-transfer. It should be noted that the same is true when the predetermined voltage $V_0$ is of a positive (+) polarity.

Therefore, the application or removal of charge relative to the latent image carrier 2 via the charge-transfer can be achieved by satisfying a condition that capacity C of the latent image carrier 2 is set in such a small range as to allow the surface potential of the latent image carrier 2 to be constant at the predetermined voltage $|V_0|$ (this is an absolute value because voltages of opposite (±) polarities are available) or constant at the ground voltage $V_1$ and by controlling the voltage to be impressed to the writing electrode 3*b* to be switched between the predetermined voltage $V_0$ and the ground $V_1$.

FIG. 3(*e*) shows the relation between the velocity (peripheral velocity) v of the latent image carrier 2 and the surface potential of the latent image carrier 2. The aforementioned relation when the writing electrode 3*b* is connected to the A side to impress the predetermined voltage $V_0$ of a negative (−) polarity to the writing electrode 3*b* is represented by a solid line in FIG. 3(*c*). As shown by the solid line in FIG. 3(*e*), the surface potential of the latent image carrier 2 increases as the velocity v increases in a region where the velocity v of the latent image carrier 2 is relatively low, and the absolute value of the surface potential of the latent image carrier 2 is constant in a region where the velocity v of the latent image carrier 2 is higher than a predetermined value. The reason of increase in the surface potential of the latent image carrier 2 with the increase in the velocity v of the latent image carrier 2 is considered as that the charge-transfer to the latent image carrier 2 is facilitated due to friction between the writing electrode 3*b* and the latent image carrier 2. The velocity v of the latent image carrier 2 has an extent above which the facilitation of the charge-transfer due to friction is no longer increased and becomes substantially constant. On the other hand, the relation between the velocity v of the latent image carrier 2 and the surface potential of the latent image carrier 2 when the writing electrode 3*b* is connected to the B side to ground the writing electrode 3*b* is represented by a dotted line in FIG. 3(*e*). As shown by the dotted line in FIG. 3(*e*), the surface potential of the latent image carrier 2 is constant at the ground voltage $V_1$ regardless of the velocity v of the latent image carrier 2. It should be noted that the, same is true when the predetermined voltage $V_0$ is of a positive (+) polarity.

FIG. 3(*f*) shows the relation between the pressing force applied to the latent image carrier 2 by the writing electrode 3*b* (hereinafter, just referred to as "the pressure of the writing electrode 3*b*") and the surface potential of the latent image carrier 2. The aforementioned relation when the writing electrode 3*b* is connected to the A side to impress the predetermined voltage $V_0$ of a negative (−) polarity to the writing electrode 3*b* is represented by a solid line in FIG. 3(*f*). As shown by the solid line in FIG. 3(*f*), the surface potential of the latent image carrier 2 relatively rapidly increases as the pressure of the writing electrode 3*b* increases in a region where the pressure of the writing electrode 3*b* is very low, and the absolute value of the surface potential of the latent image carrier 2 is constant in a region where the pressure of the writing electrode 3*b* is higher than a predetermined value. The reason of the rapid increase in the surface potential of the latent image carrier 2 with the increase in the pressure of the writing electrode 3*b* is considered as that the contact between the writing electrode 3*b* and the latent image carrier 2 is further ensured by the increase in the pressure of the writing electrode 3*b*. The pressure of the writing electrode 3*b* has an extent above which the contact certainty between the writing electrode 3*b* and the latent image carrier 2 is no longer increased and becomes substantially constant. On the other hand the relation between the pressure of the writing electrode 3*b* and the surface potential of the latent image carrier 2 when the writing electrode 3*b* is connected to the B side to ground the writing electrode 3*b* is represented by a dotted line in FIG. 3(*f*). As shown by the dotted line in FIG. 3(*f*), the surface potential of the latent image carrier 2 is constant at the ground voltage $V_1$ regardless of the pressure of the writing electrode 3*b*. It should be noted that the same is true when the predetermined voltage $V_0$ is of a positive (+) polarity.

Therefore, the application or removal of charge relative to the latent image carrier 2 via the charge-transfer can be securely and easily achieved by satisfying conditions that the resistance R of the writing electrode 3*b* and the capacity C of the latent image carrier 2 are set in such a manner as to allow the surface potential of the latent image carrier 2 to be constant at the predetermined voltage and that the velocity v of the latent image carrier 2 and the pressure of the writing electrode 3*b* are set in such a manner as to allow the surface potential of the latent image carrier 2 to be constant at the predetermined voltage, and by controlling the voltage to be impressed to the writing electrode 3*b* to be switched between the predetermined voltage $V_0$ and the ground voltage $V_1$.

Though the predetermined voltage $V_0$ to be impressed to the writing electrode 3*b* is a direct current voltage in the aforementioned embodiment, an alternating current voltage may be superimposed on a direct current voltage. When an alternating current voltage is superimposed, it is preferable that a DC component is set to be a voltage to be impressed to the latent image carrier 2, the amplitude of AC component is set to be twice or more as large as the discharge starting voltage $V_{th}$, and the frequency of AC component is set to be higher than the frequency in rotation of the latent image carrier 2 by about 500–1,000 times (for example, assuming that the diameter of the latent image carrier 2 is 30ϕ and the peripheral velocity of the latent image carrier 2 is 180 mm/sec, the frequency in rotation of the latent image carrier 2 is 2 Hz so that the frequency of AC component is 1,000–2,000 Hz.).

By superimposing an alternating current voltage on a direct current voltage as mentioned above, the application or removal of charge via discharge of the writing electrode 3*b* is further stabilized. In addition, the writing electrode vibrates because of the existence of the alternating current, thereby removing foreign matters adhering to the writing electrode 3*b* and thus preventing contamination of the writing electrode 3*b*.

Figure 5:
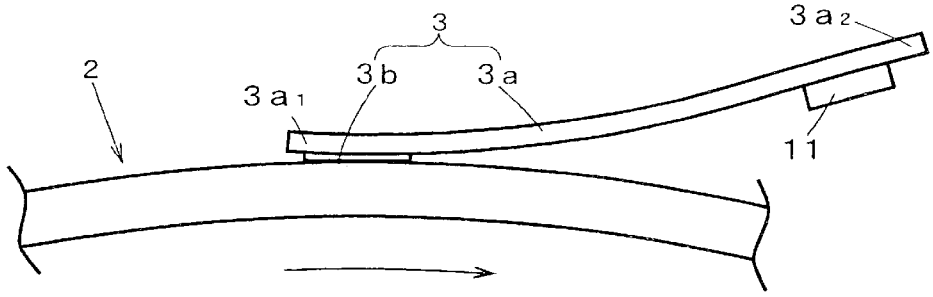
FIG. 5 is a schematic illustration showing an example of the writing device, as seen in an axial direction of the latent image carrier.

Description will now be made as regard to the flexible substrate 3*a* supporting the writing electrodes 3*b* of the writing head 3. FIG. 5 is a schematic illustration showing an example of the writing head 3, as seen in an axial direction of the latent image carrier 2. As mentioned, the substrate 3*a* is made of a flexible material being relatively soft and elastic such as a FPC. The substrate 3*a* has a plurality of writing electrodes 3*b* fixed at its end $3a_1$ as shown in FIG. 5. The writing electrodes 3*b* are aligned in a row extending in the axial direction (hereinafter, sometimes referred to as "main scanning direction") of the latent image carrier 2 as will be described later and the substrate 3*a* is accordingly formed in a rectangular plate shape having a length, along the axial direction of the latent image carrier 2, which is substantially the same as the axial length of the charged layer 2*d* of the latent image carrier 2. The substrate 3*a* is fixed by a suitable fixing member at an end $3a_2$ opposite to the end $3a_1$ where the writing electrodes 3*b* are fixed. The substrate 3*a* is disposed to extend from the right side in FIG. 5 to oppose the rotational direction (indicated by an arrow the clockwise direction) of the latent image carrier 2. It should be noted that the substrate 3*a* may be disposed to extend from the left side in FIG. 5 in the same direction as the rotational direction of the latent image carrier 2.

In this state, the substrate 3*a* is elastically slightly deflected to produce weak elastic restoring force. By this elastic restoring force, the writing electrodes 3*b* are lightly pressed against and in contact with the latent image carrier 2 with a small pressing force. The fact that the pressing force of the writing electrodes 3*b* onto the latent image carrier 2 is small can suppress the wearing of the charged layer 2*d* of the latent image carrier 2 due to the writing electrodes 3*b*, thus improving the durability. The fact that the writing electrodes 3*b* are kept in contact with the charged layer 2*d* by the elastic force of the substrate 3*a* achieves stable contact of the writing electrodes 3*b* to the charged layer 2*d*. The substrate 3*a* has drivers 11 fixed to the end $3a_2$ for controlling the operation of the writing electrodes 3*b*.

In case where the substrate 3*a* is disposed to oppose the rotational direction of the latent image carrier 2 as shown in FIG. 5, the substrate 3*a* can remove foreign matters adhering to the latent image carrier 2, that is, the writing head 3 is provided with a cleaning characteristic. In case where the substrate 3*a* is disposed to extent in the same direction of the rotational direction of the latent image carrier 2, foreign matters adhering to the latent image carrier 2 are allowed to pass between the substrate 3*a* and the latent image carrier 2.

Figure 6:
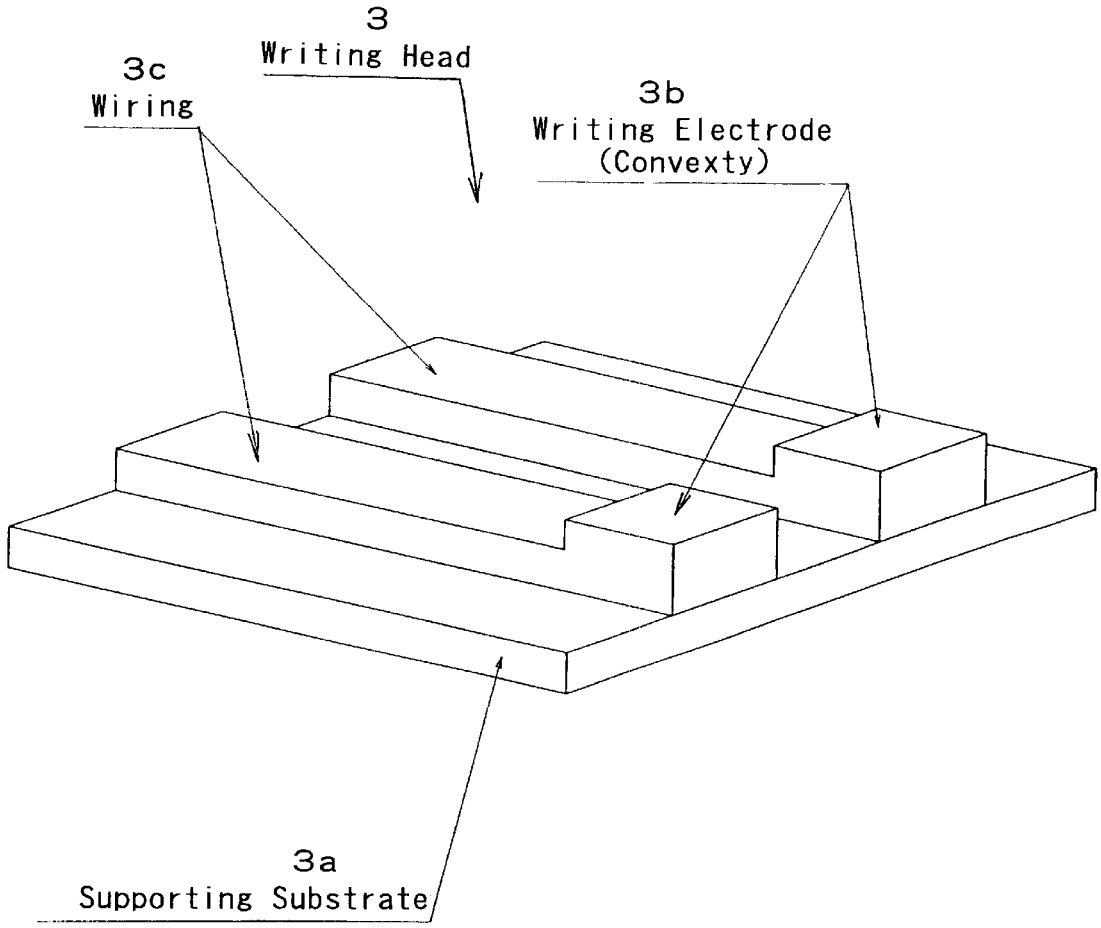
FIG. 6 is a perspective view partially showing the writing head in the image forming apparatus of the embodiment shown in FIGS. 3 through 5.

FIG. 6 is a perspective view partially showing the writing head in the image forming apparatus of this embodiment.

The writing head shown in FIG. 3(*a*) through FIG. 5 comprises a supporting substrate 3*a* made of a flexible material such as FPC of PET, a plurality of wirings 3*c* (only two wirings are illustrated in FIG. 6) which are made of a conductive material and are placed on the supporting substrate 3*a*, each wiring 3*c* extending in a direction perpendicular to the main scanning direction of the latent image carrier 2, and writing electrodes 3*b* each of which is formed at one end of each wiring 3*c* and is composed of a convexity in a rectangular parallelopiped or a cube form to project toward the latent image carrier 2 as shown in FIG. 6. Therefore, the writing electrodes 3*b* are aligned in the main scanning direction. It should be noted that the other end of each writing 3*c* is connected to a driver 11 as will be described later.

Figure 7:
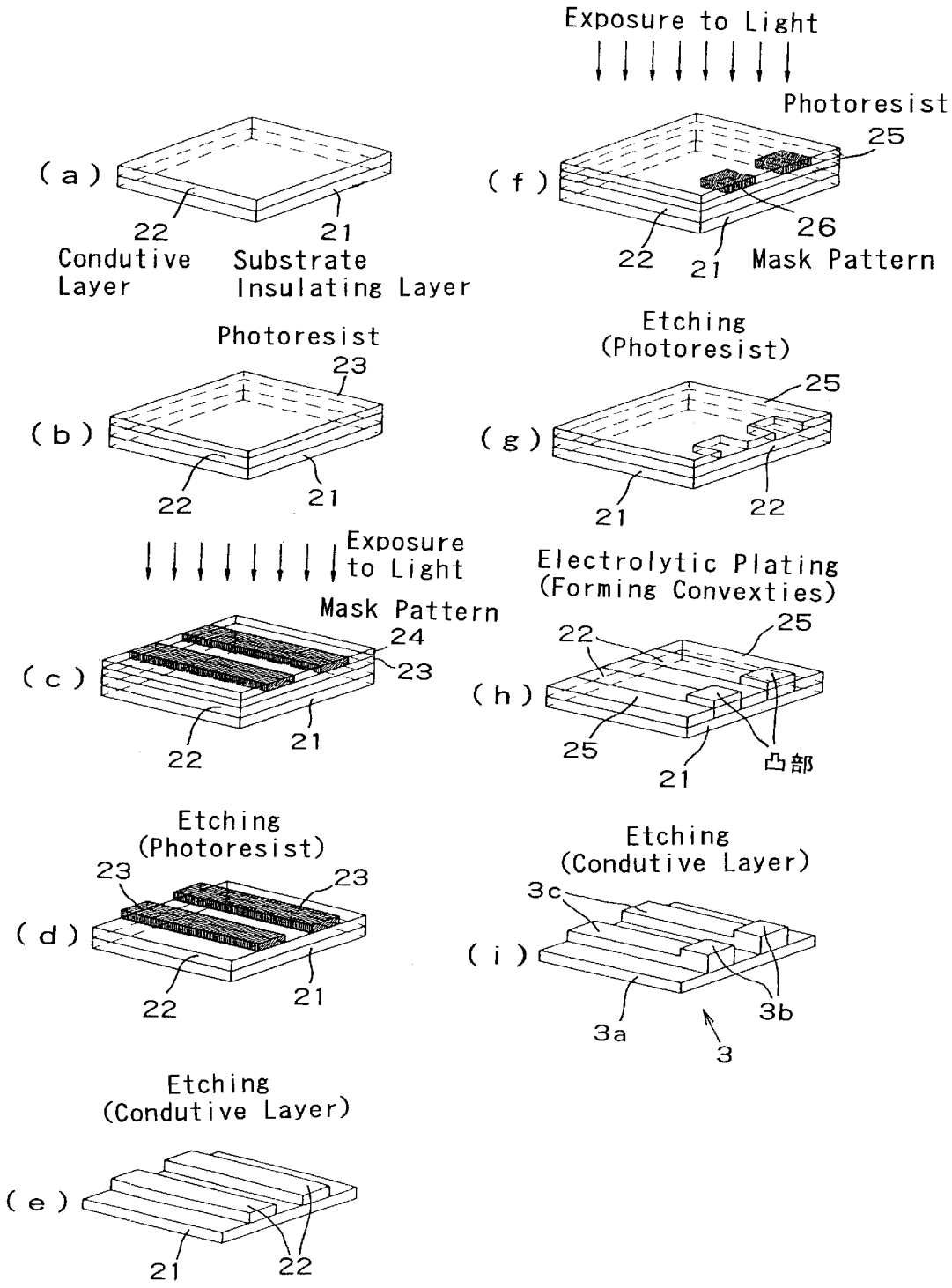
FIG. 7, parts (*a*)–(*i*) are views for explaining one example of the method for manufacturing the writing head shown in FIG. 6.

FIGS. 7(*a*) through 7(*i*) are views for explaining one example of the method for manufacturing the writing head shown in FIG. 6.

The method for forming the writing electrodes 3*b* composed of convexities aligned in the main scanning direction comprises superposing and bonding a conductive layer 22 such as Cu onto a substrate insulating layer 21 which is elastically flexible as shown in FIG. 7(*a*); and then coating the conductive layer 22 with a photoresist 23 as shown in FIG. 7(*b*). The coating of the photoresist 23 may be conducted by laminating a dry film on the conductive layer 22 or by applying liquid photoresist onto the conductive layer 22 using a technique of dip coating.

After that, as shown in FIG. 7(*c*), a mask pattern 24 corresponding to a wiring pattern 9 as will be described later is put on the photoresist 23 and is then exposed to light. As shown in FIG. 7(*d*), sensitized portions of the photoresist 23 are removed by etching and the mask pattern is then removed so as to expose portions of the conductive layer 22. After that, as shown in FIG. 7(*e*), the portions of the conductive layer 22 exposed due to the removal of the photoresist 23 are removed by acid (sulfuric acid) etching and residual portions of the photoresist (non-etched portions of the photoresist) 23 are also removed.

Then, as shown in FIG. 7(*f*), another photoresist 25 is formed on the substrate insulating layer 21 and the residual portions of the conductive layer 22 to coat them by the same coating method as mentioned above. Another mask pattern 26 is prepared which is designed to sensitize portions of the photoresist 25 corresponding to locations, where the electrode convexities should be formed, on the residual portions of the conductive layer 22. The mask pattern 26 is put on the photoresist 25 and is then exposed to light. Sensitized portions of the photoresist 25, i.e. the portions of the photoresist 25 where the electrode convexities should be formed are removed by etching so that the corresponding portions of the conductive layer 22 are exposed as shown in FIG. 7(*g*).

After that, as shown in FIG. 7(*h*), the exposed portions of the conductive layer 22 are processed by electrolytic plating 27 to form rectangular parallelopiped or cubic convexities. Finally, as shown in FIG. 7(*i*), the residual photoresist 25, the most front layer, is removed by etching, thereby manufacturing a writing head, as shown in FIG. 6, on which wirings 3*c* and writing electrodes 3*b* composed of rectangular parallelopiped or cubic convexities are formed.

It should be understood that the method of manufacturing the writing head having writing electrodes 3*b* composed of convexities is not limited to the method illustrated in FIGS. 7(*a*)–7(*i*) and any suitable method which can form electrodes composed of convexities and wirings on a flexible substrate 3*a* may be employed.

Figure 8:
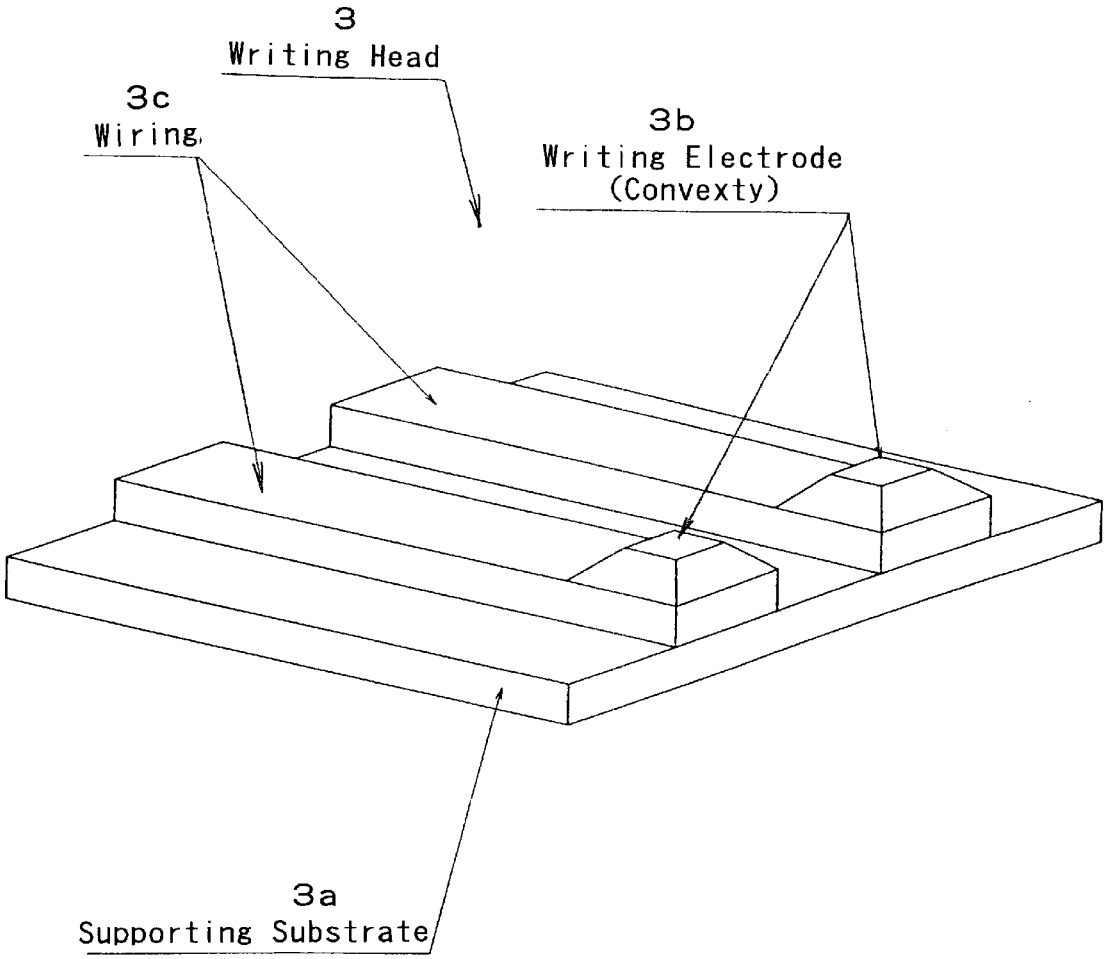
FIG. 8 is a perspective view similar to FIG. 6, but partially showing another example of the writing head in the image forming apparatus of the embodiment shown in FIG. 3 through FIG. 5.
Figure 9:
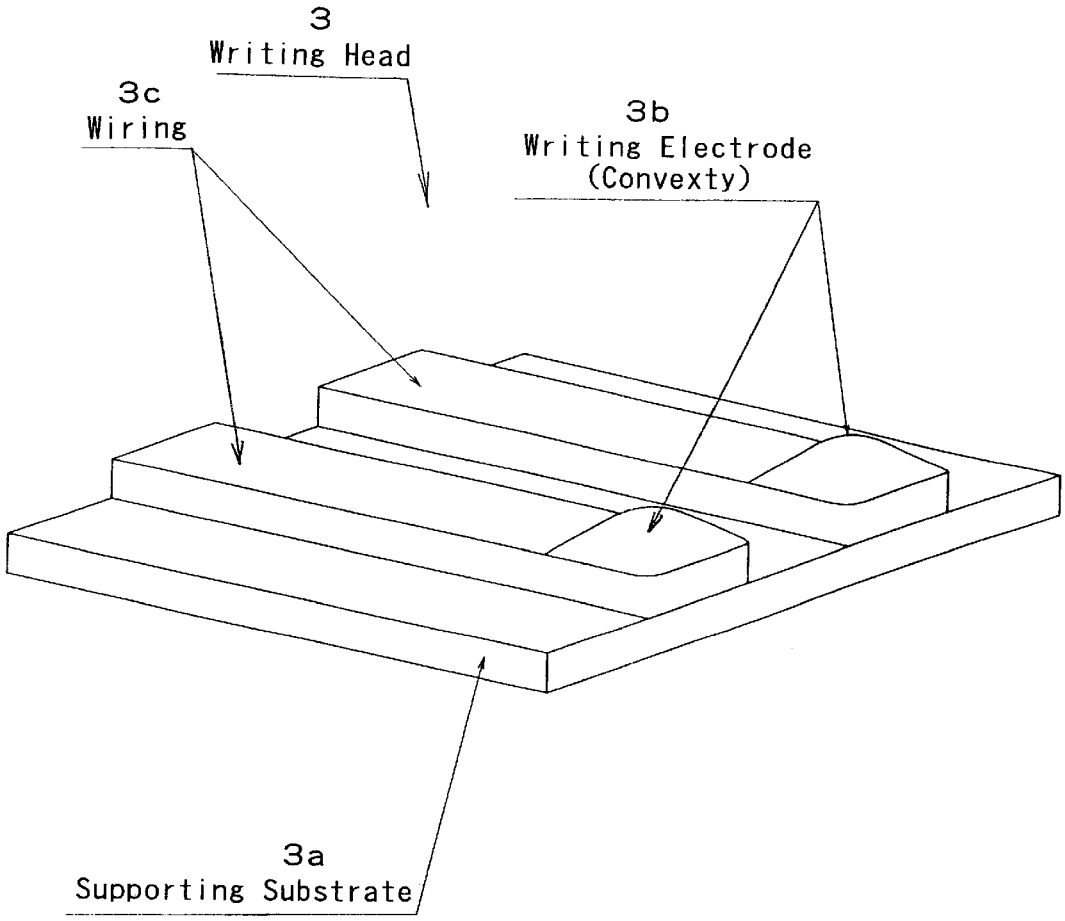
FIG. 9 is a perspective view similar to FIG. 6, but partially showing another example of the writing head in the image forming apparatus of the embodiment shown in FIG. 3 through FIG. 5.
Figure 10:
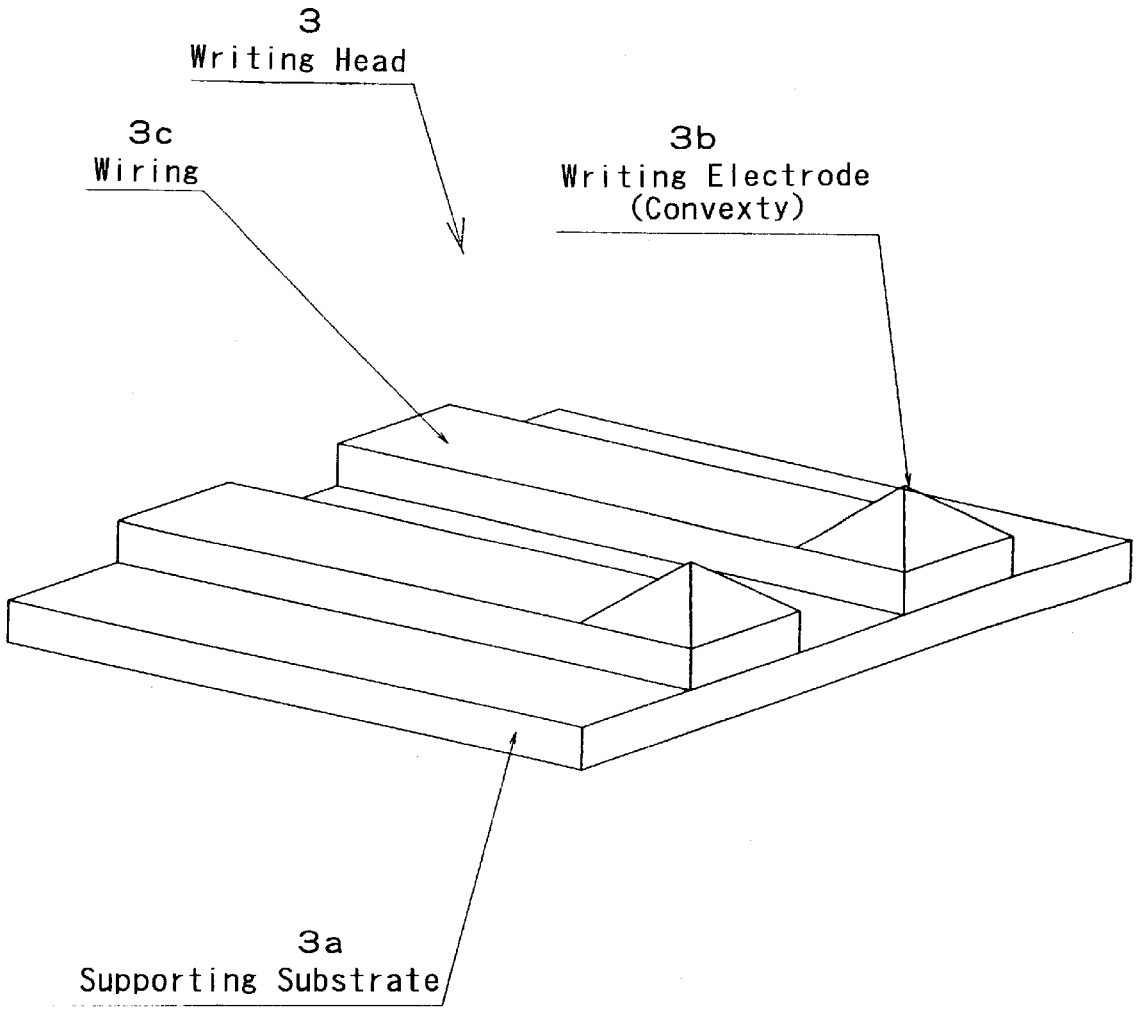
FIG. 10 is a perspective view similar to FIG. 6, but partially showing another example of the writing head in the image forming apparatus of the embodiment shown in FIG. 3 through FIG. 5.

FIG. 8 through FIG. 10 are perspective views similar to FIG. 6, but partially showing another examples of the writing head in the image forming apparatus of this embodiment.

In the writing head 3 of the example shown in FIG. 6, each convexity composing each writing electrode 3*b* is formed in a rectangular parallelopiped or a cube. However, in the writing head 3 of the example shown in FIG. 8, each convexity composing each writing electrode 3*b* is formed in a truncated square pyramid. In the writing head 3 of the example shown in FIG. 9, each convexity is formed by rounding off the top peripheral edges of a truncated square pyramid of the example shown in FIG. 8. Further, in the writing head 3 of the example shown in FIG. 10, each convexity composing each writing electrode 3*b* is formed in a square pyramid. Furthermore, as the configuration of the convexity, various configurations are available, including a circular cylinder, a cone, a truncated cone, an elliptic cylinder (cylinder of which section is elliptic), an elliptic cone (cone of which section is elliptic), a truncated elliptic cone (truncated cone of which section is elliptic), an oval cylinder (cylinder of which section is oval), an oval cone (cone of which section is oval), a truncated oval cone (truncated cone of which section is oval), a triangle column, a triangle pyramid, a truncated triangle pyramid, a polygonal column (having five corners or more), a polygonal pyramid (having five corners or more), and a truncated polygonal pyramid (having five corners or more).

Figure 11:
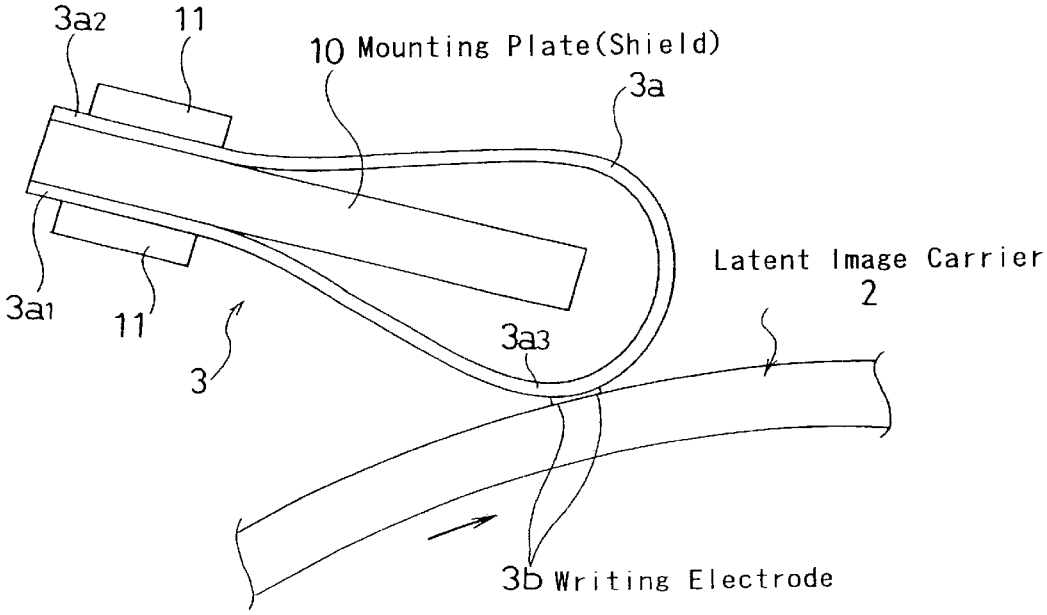
FIG. 11 is a schematic illustration showing another example of the writing device, as seen in an axial direction of the latent image carrier.

FIG. 11 is a schematic illustration showing another example of the writing head 3, as seen in an axial direction of the latent image carrier 2. In the former example, the rectangular substrate 3*a* is fixed at its end $3a_2$ and is thus set simply to be elastically slightly deflected. In this example, however, a rectangular substrate 3*a* which is made of the same material as the substrate 3*a* of the former example is bent at its center of a direction perpendicular to the axial direction of the latent image carrier 2 into a hair pin curve with a curve top extending along a line of the axial direction of the latent image carrier 2 and the both ends $3a_1$, $3a_2$ of the substrate 3*a* are fixed by a suitable fixing member. In this case, a conductive mounting plate (shield) 10 is interposed between the both ends $3a_1$ and $3a_2$ of the substrate 3*a* for preventing the crosstalk between two sections of the substrate 3*a* about the curve top, i.e. the upper and lower sections in FIG. 11.

Also in this example, the length of the substrate 3*a* in the axial direction of the latent image carrier 2 is set substantially the same as the axial length of the charged layer 2*d* of the latent image carrier 2 and the substrate 3*a* is provided at a predetermined location of a hair pin curve portion (a curved portion) $3a_3$ with a plurality of writing electrodes 3*b* aligned in the main scanning direction. In a state where the both ends $3a_1$, $3a_2$ of the substrate 3*a* are fixed as shown in FIG. 11, the hair pin curve portion $3a_3$ of the substrate 3*a* is elastically slightly deflected so that the writing electrodes 3*b* are lightly pressed against and in contact with the latent image carrier 2 by the weak elastic restoring force of the hair pin curve portion $3a_3$ of the substrate 3*a*. In the writing head 3 of this example, the substrate 3*a* is supported by the both ends $3a_1$, $3a_2$, thus allowing the writing electrodes 3*b* to be further securely and stably kept in contact with the latent image carrier 2 as compared to the former example. Though drivers 11 for the electrodes 3*b* fixed to the both ends $3a_1$, $3a_2$ of the substrate 3*a*, respectively are shown in FIG. 11, this arrangement corresponds to an array pattern of electrodes shown in FIG. 15 as will be described later.

Figure 12:
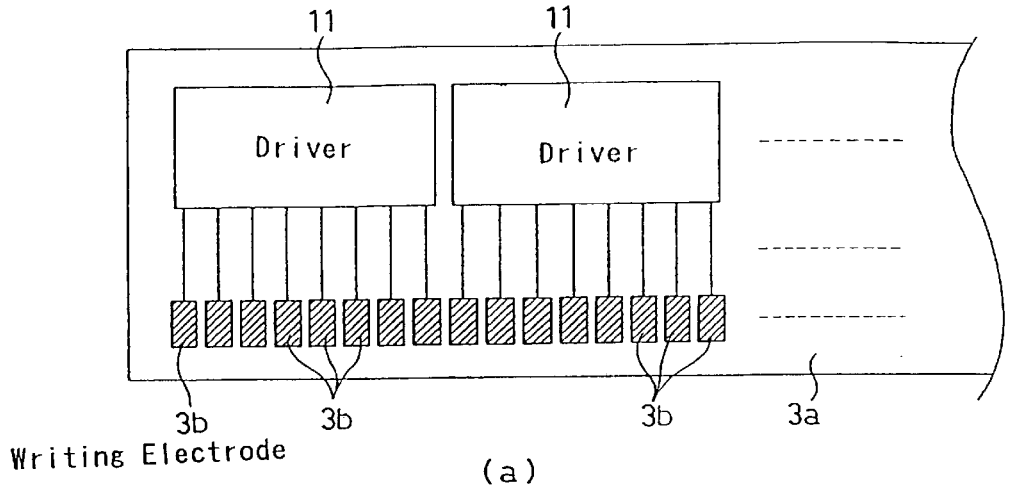
FIG. 12, parts (*a*)–(*c*) show array patterns for aligning a plurality of writing electrodes in the axial direction of the latent image carrier, wherein part (*a*) is a view showing the simplest array pattern for writing electrodes and parts (*b*) and (*c*) are views showing array patterns for writing electrodes which achieve to solve problems of the array pattern shown in part (*a*)
Figure 12:
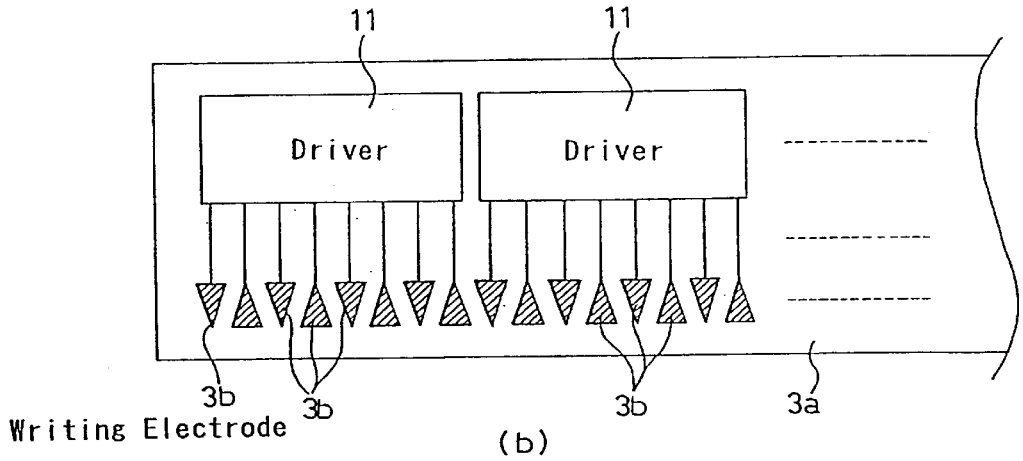
Figure 12:
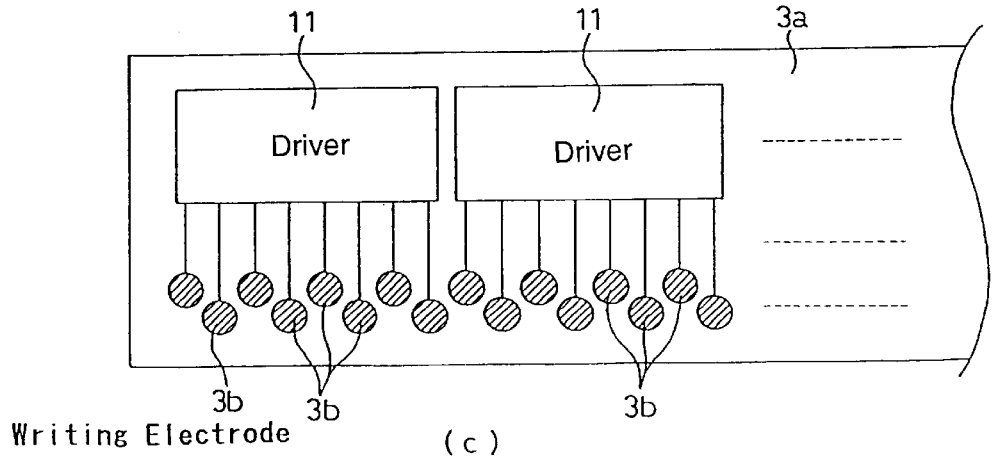

FIGS. 12(*a*)–12(*c*) show array patterns for aligning a plurality of writing electrodes 3*b* in the main scanning direction, wherein FIG. 12(*a*) is a view showing the simplest array pattern for writing electrodes and FIGS. 12(*b*) and 12(*c*) are views showing array patterns for writing electrodes which achieve to solve problems of the array pattern shown in FIG. 12(*a*).

In the simplest array pattern (electrode pattern) for the writing electrodes 3*b*, as shown in FIG. 12(*a*), a plurality of rectangular writing electrodes 3*b* are aligned in a row extending in the main scanning direction to secure an image formation region. The row is single in a direction perpendicular to the axial direction of the latent image carrier (hereinafter, sometimes referred to as "feeding direction"). In this case, among the writing electrodes 3*b*, a predetermined number (eight in the illustrated example) of writing electrodes 3*b* are connected to and thus united by a driver 11 which controls the corresponding electrodes 3*b* by switching the supply voltage between the predetermined voltage $V_0$ or the ground voltage $V_1$. Plural units of writing electrodes 3*b* are aligned in the same row extending in the main scanning direction. The row of the drivers is single in the feeding direction.

However, when simple rectangular electrodes 3*b* are simply aligned in a single row extending in the main scanning direction just like this pattern, there should be clearances between adjacent electrodes 3*b*. Portions of the surface of the latent image carrier 2 corresponding to the clearances can not be subjected to the application or removal of charge, leading to an image defect due to linear stains. Therefore, in the array pattern (hereinafter, sometimes referred to as "electrode pattern") for the writing electrodes 3*b* shown in FIG. 12(*b*), the writing electrodes 3*b* are each formed in a triangle and are arranged in such a manner that the orientations of the triangles of the writing electrodes 3*b* are alternately inverted (that is, in the orthographic position and the inverted position).

Figure 13:
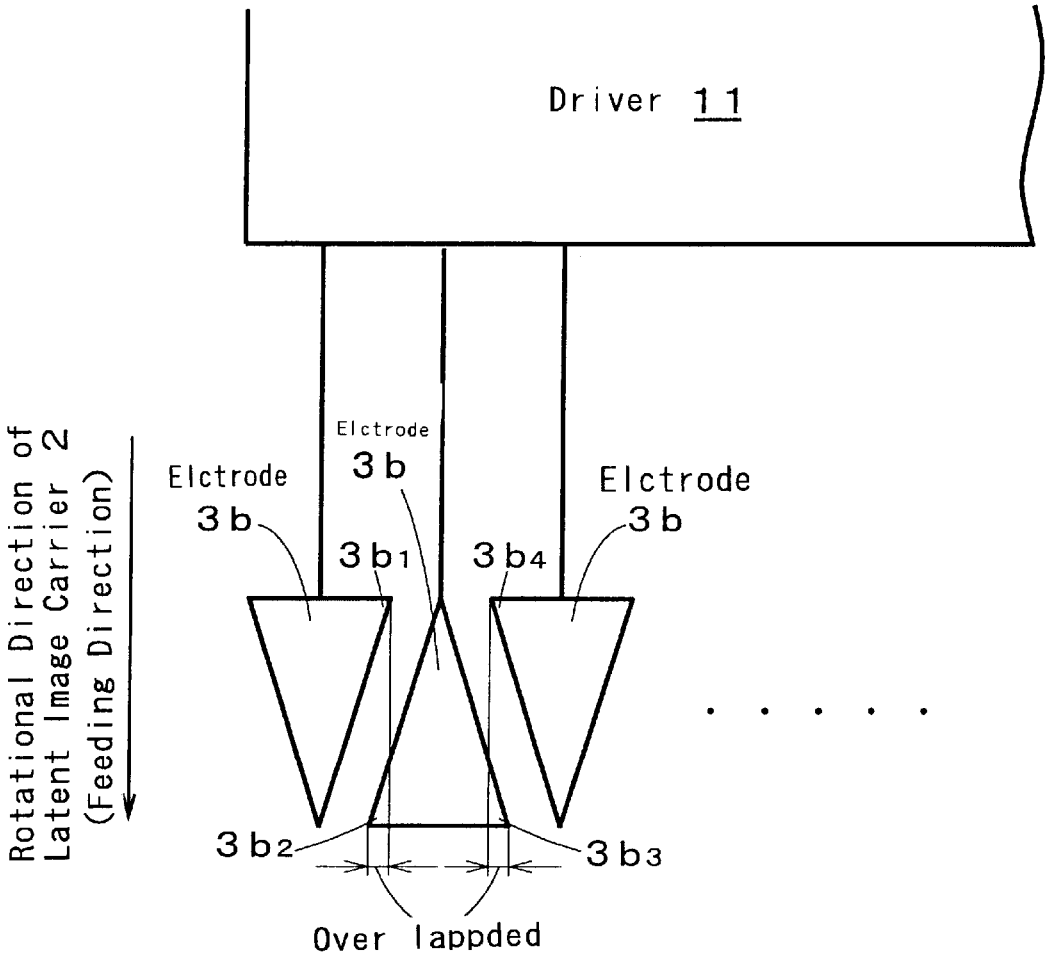
FIG. 13 is a view for explaining the state that adjacent writing electrodes are partially overlapped with each other as seen in the rotational direction of the latent image carrier.

In this case, the writing electrodes 3*b* are arranged such that, as shown in FIG. 13, one end $3b_2$ of the triangle base of one writing electrode 3*b* is overlapped with one end $3b_1$, of the triangle base of a next writing electrode 3*b* on the left of the one writing electrode 3*b*, as seen in the direction perpendicular to the axial direction of the latent image carrier 2 (the rotational direction of the latent image carrier 2; the feeding direction) while the other end $3b_3$ of the triangle base of the one writing electrode 3*b* is overlapped with one end $3b_4$ of the triangle base of the other next writing electrode 3*b* on the right of the one writing electrode 3*b*, as seen in the rotational direction of the latent image carrier 2. The design of partially overlapping adjacent writing electrodes 3*b* in the rotational direction of the latent image carrier 2 can eliminate such portions in the surface of the latent image carrier 2 that are not subjected to the application or removal of charge, thereby achieving application or removal of charge relative to the entire surface of the latent image carrier 2. This design can therefore prevent the occurrence of image defect due to linear stains. Furthermore, foreign matters adhering to the surface of the latent image carrier 2 are allowed to pass through spaces between the adjacent writing electrodes 3*b*, thereby preventing the occurrence of filming due to foreign matters adhering to the writing electrodes 3*b*.

Also in this example, in the same manner as the example shown in FIG. 12(*a*), plural units are each formed by connecting a predetermined number of electrodes 3*b* to one driver 11 and are aligned in one row. It should be noted that, instead of triangle, each electrode 3*b* may be formed in any configuration that allows adjacent electrodes to be partially overlapped with each other as seen in the feeding direction, for example, a trapezoid, a parallelogram, and a configuration having at least one oblique side among sides opposed to adjacent electrodes 3*b*.

In the array pattern for the writing electrodes 3*b* shown in FIG. 12(*c*), the writing electrodes 3*b* are each formed in circle and are aligned in two rows (first and second rows) extending in the main scanning direction in such a manner that the writing electrodes 3*d* are arranged in a zigzag fashion. The two rows are arranged in parallel with each other in the feeding direction. In this case, the electrodes are arranged such that electrodes which are in different rows but adjacent to each other are partially overlapped with each other as seen in the feeding direction. Also this array pattern can eliminate such portions in the surface of the latent image carrier 2 that are not subjected to the application or removal of charge, thereby achieving application or removal of charge relative to the entire surface of the latent image carrier 2.

As mentioned above, by aligning the writing electrodes 3*b* in two parallel rows each extending in the main scanning direction in such a manner that the writing electrodes 3*d* are arranged in a zigzag fashion, portions of the writing electrodes 3*b* can be easily and securely overlapped as seen in the feeding direction and the array structure of the writing electrodes 3*b* can be simplified.

Figure 14:
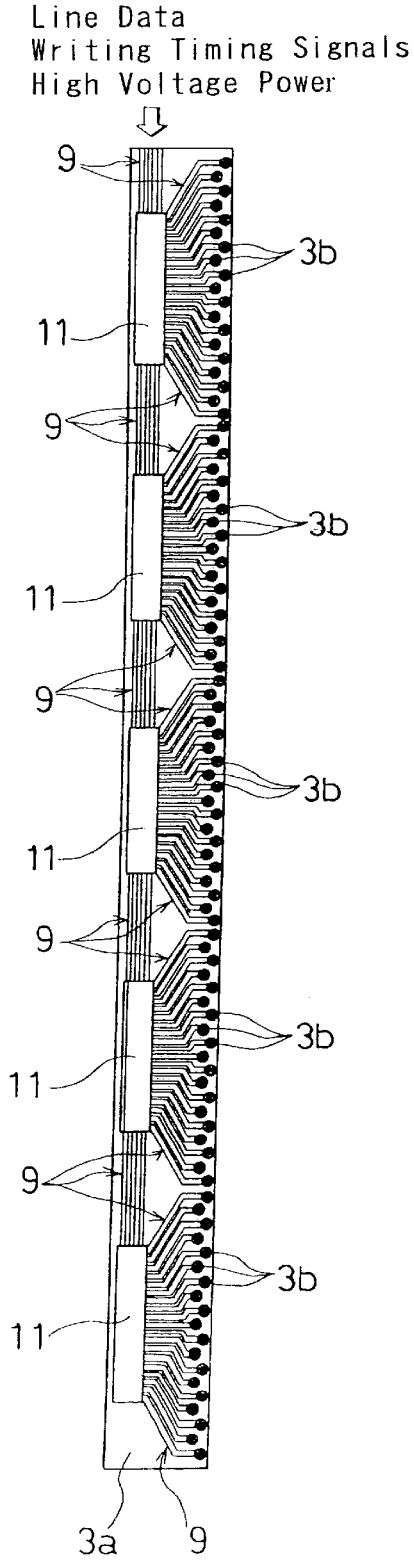
FIG. 14 is a view for illustrating the array pattern for the writing electrodes and the wiring pattern for drivers.
Figure 17:
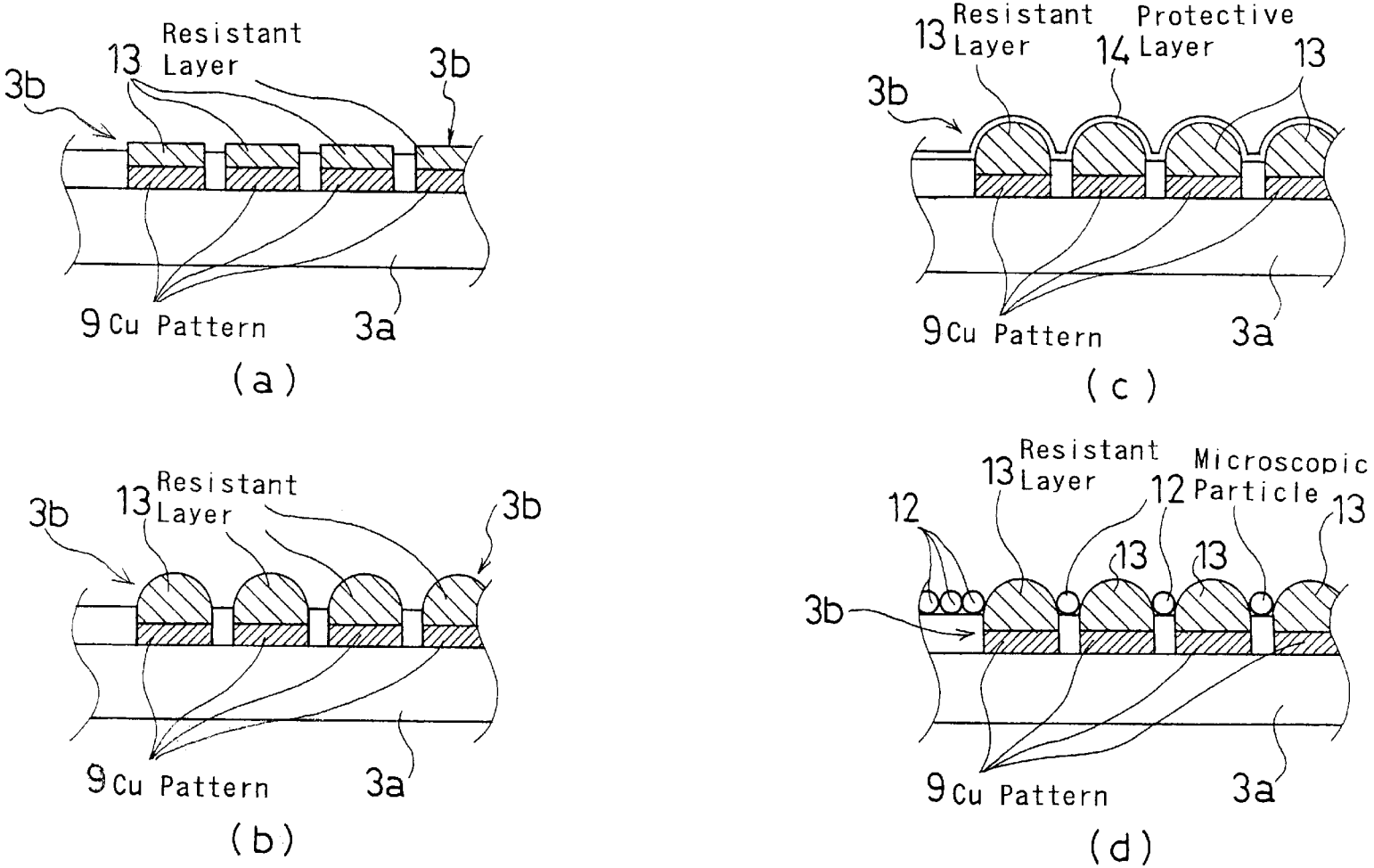
FIG. 17, parts (*a*)–(*d*) are sectional views each showing an example of the writing electrodes of the writing device.

In this example, plural units are each formed of a predetermined number of electrodes 3*b* some of which are in the first row and the other are in the second row by connecting these electrodes 3*b* to one driver 11 and are aligned in the main scanning direction. The respective drivers 11 are disposed on the same side of the corresponding electrodes 3*b*. As shown in FIG. 14, the respective drivers 11 are electrically connected by conductive patterns (Cu patterns) 9 made of copper (Cu) foil which is formed on the substrate 3*a* and each line of which is formed into a thin flat bar-like shape having a rectangular section (sections are shown in FIGS. 17(*a*)–17(*d*) as will be described later). In the same manner, the drivers 11 are electrically connected to the corresponding electrodes 3*b* by the conductive patterns 9. In addition, the electrodes 3*b* and the drivers 11 are connected to a power source (not shown). The conductive patterns 9 can be formed by a conventional known pattern forming method such as etching.

Line data signals, writing timing signals, and high voltage power are supplied to the respective drivers 11 from the upper side in FIG. 14 so that the drivers 11 controls the corresponding electrodes 3*b* by switching the supply voltage between the predetermined voltage $|V_0|$ and the ground voltage $V_1$ according to the line data signals and the writing timing signals.

It should be noted that an oval, an ellipse, a square, a pentagon, or a polygon having 6 or more corners may be employed as the shape of the electrodes, instead of the aforementioned shapes.

Figure 15:
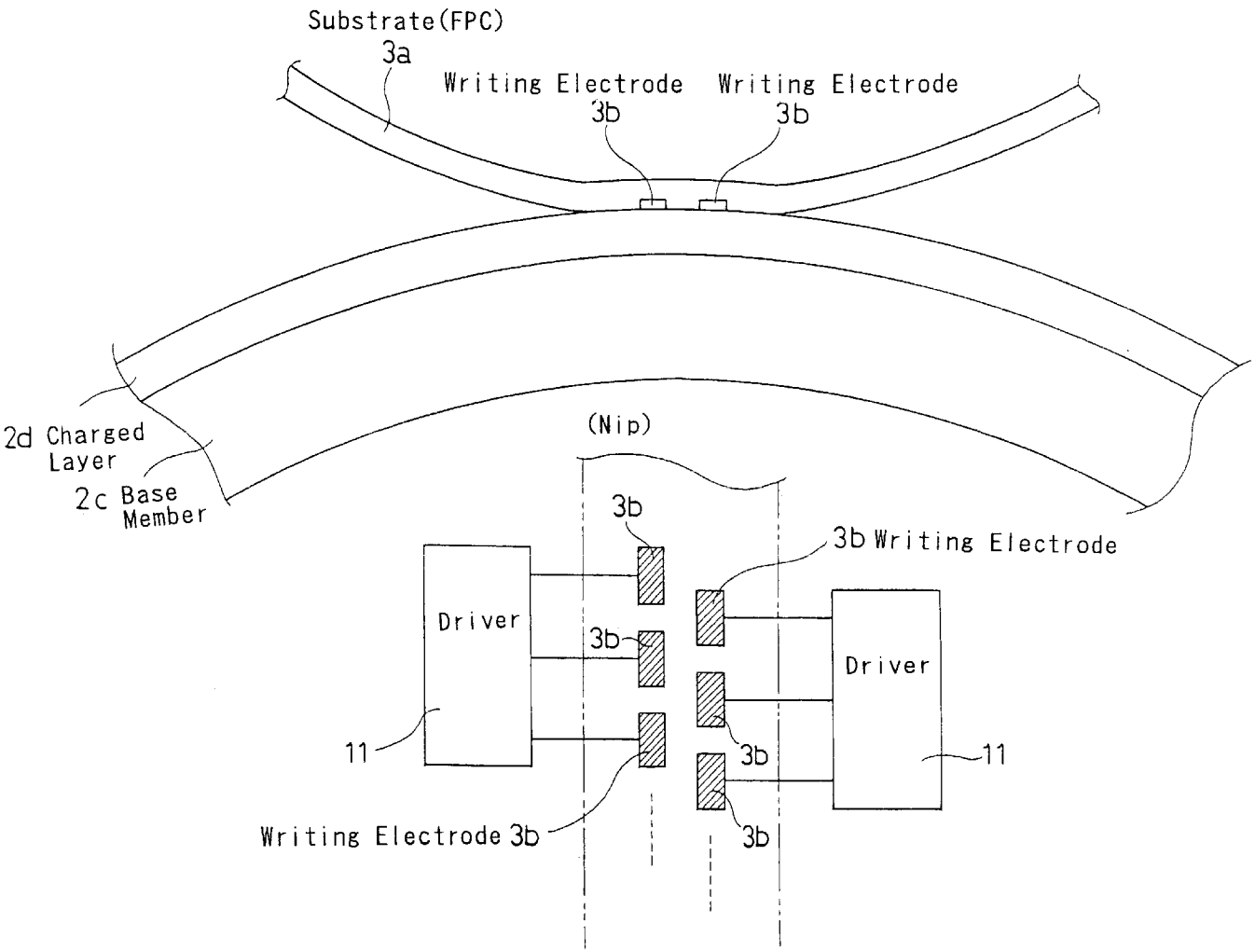
FIG. 15 is a view showing still another example of the array pattern for the writing electrodes.

FIG. 15 is a view showing still another example of the array pattern for the writing electrodes 3*b*.

As shown in FIG. 15, in this array pattern for the writing patterns 3*b*, the writing electrodes 3*b* are each formed in rectangle. In the same manner as the example shown in FIG. 12(*c*), the writing electrodes 3*b* are aligned in two parallel rows (first and second rows) extending in the main scanning direction in such a manner that the writing electrodes 3*d* are arranged in a zigzag fashion and arranged such that electrodes which are in different rows but adjacent to each other are partially overlapped with each other as seen in the feeding direction. Also this array pattern can eliminate such portions in the surface of the latent image carrier 2 that are not subjected to the application or removal of charge, thereby achieving uniform application or removal of charge relative to the entire surface of the latent image carrier 2. By rounding off the four corners of the rectangle of each writing electrode 3*b*, sharp angled portions (edges) are eliminated, thereby preventing the discharge between adjacent writing electrodes, but not illustrated.

In this example, a predetermined number of electrodes 3*b* in the first row are connected to and united by one driver 11 and a predetermined number of electrodes 3*b* in the second row are connected to and united by another driver 11. For each row, plural units are formed and aligned. The drivers 11 for the electrodes 3*b* in the first row are disposed on the opposite side of the drivers 11 for the electrodes 3*b* in the second row such that these electrodes 3*b* are located therebetween and, as shown in FIG. 11, the opposed drivers 11 are fixed to the both ends $3a_1$, $3a_2$, respectively, of the substrate 3*a* which is bent in a hair pin curve. It should be understood that the rounding off corners of the writing electrodes is not limited to rectangular electrodes and may be applied to triangular electrodes and other polygonal electrodes.

Figure 16:
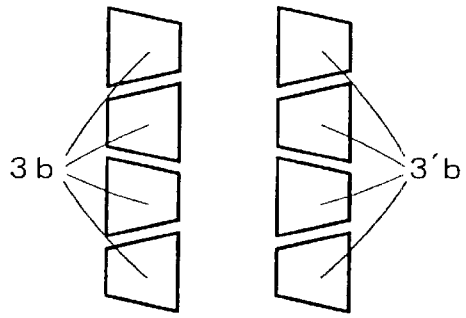
FIG. 16, parts (*a*)–(*d*) are views showing still another examples of the array pattern for the writing electrodes.
Figure 16:
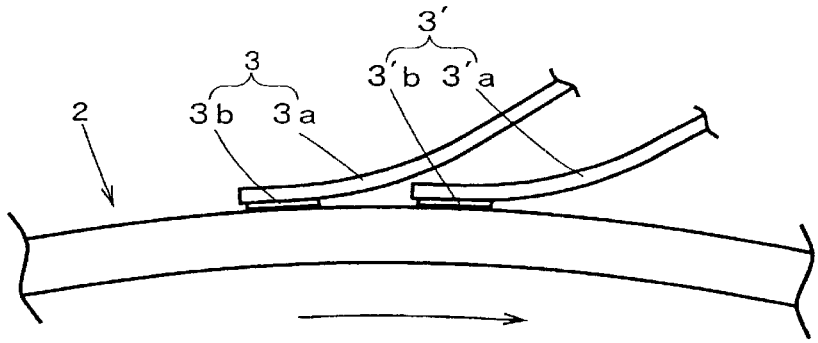
Figure 16:
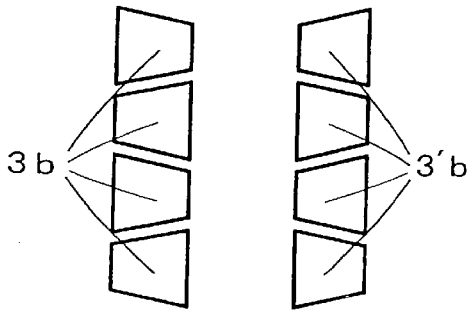
Figure 16:
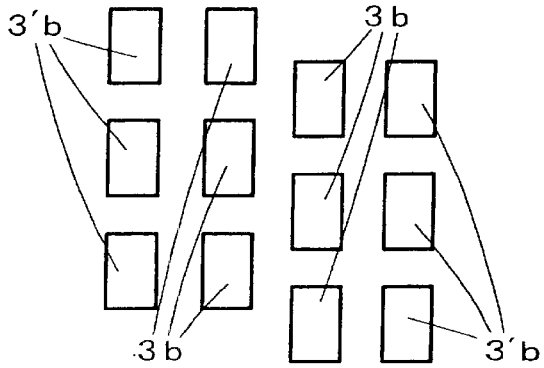

FIGS. 16(*a*)–16(*d*) are views showing still another examples of the array pattern for the writing electrodes 3*b*.

In any of the array patterns for the writing electrodes 3*b* of the aforementioned examples shown in FIG. 12(*c*) and FIG. 15, the writing electrodes 3*b* are aligned in two parallel rows extending in the main scanning direction in such a manner that the writing electrodes 3*d* are arranged in a zigzag fashion. In the array pattern for the writing electrodes 3*b* of an example shown in FIGS. 16(*a*) and 16(*b*), however, writing electrodes 3*b* are aligned in two rows (first and second rows) which are completely identical to each other and spaced at a predetermined distance in the direction perpendicular to the axial direction of the latent image carrier 2, wherein the first row consists of writing electrodes 3*b* which are, for example, trapezoidal and the second row consists of writing electrodes 3'*b* corresponding to the writing electrodes 3*b* of the first row. That is, two identical writing electrodes 3*b*, 3'*b* are arranged in a line along the feeding direction. This design achieves further secured and stable application of charge relative to the charged layer 2*d* of the latent image carrier 2. It should be noted that, in the same manner as the example shown in FIG. 12(*b*), opposed oblique sides of adjacent trapezoidal electrodes 3*b* or 3'*b* in the same row are partially overlapped with each other as seen in the feeding direction.

In the array pattern of an example shown in FIG. 16(*c*), the orientations of trapezoids of the writing electrodes 3*b* in the first row are mirror image of those of the writing electrodes 3'*b* in the second row in the example shown in FIG. 16(*b*). The array pattern of an example shown in FIG. 16(*d*) includes two additional rows in addition to the array pattern shown in FIG. 15. Each additional row is arranged adjacent to and in parallel with each of the rows shown in FIG. 15 in the feeding direction, wherein the writing electrodes 3*b* in the rows shown in FIG. 15 are arranged in zigzag fashion. The writing electrodes 3'*b* in each additional row are identical and correspond to those in the adjacent row so that two identical writing electrodes 3*b*, 3'*b* are arranged in a line along the feeding direction. The actions and effects of these examples are equal to those of the example shown in FIG. 16(*c*).

FIGS. 17(*a*)–17(*d*) are sectional views each showing an example of the writing electrodes 3*b* of the writing device 3. In the drawings for the aforementioned examples, the writing electrodes 3*b* of the writing device 3 are illustrated with their contact portions to the latent image carrier 2 facing downward. In FIGS. 17(*a*)–17(*d*), however, the writing electrodes are illustrated with their contact portions to the latent image carrier 2 facing upward.

In the writing device 3 of an example shown in FIG. 17(*a*), a resistant layer 13 having a rectangular section is formed on each electrode forming portion of the surface of the conductive pattern (Cu pattern) 9 formed on the substrate 3*a* so as to form each writing electrode 3*b* having double layered structure. The resistant layer 13 can be formed by a conventional known coating method, for example by using an inkjet printer. Another known coating means may be employed instead of the inkjet printer. In case of using an inkjet printer, the thickness of the resistant layer 13 can be controlled with high precision, thereby achieving further accurate control of charge on the latent image carrier 2. When the resistance of the resistant layer 13 is relatively small, the application or removal of charge is dominated by the charge-transfer between the writing electrodes 3*b* and the latent image carrier 2. On the other hand, when the resistance of the resistant layer 13 is relatively large, the application or removal of charge is dominated by the discharge between the writing electrodes 3*b* and the latent image carrier 2.

When the resistance value of the writing electrode 3*b* is set at $10^8$ Ωcm or less, a predetermined time constant can be ensured, thus achieving uniform charge. On the other hand, when the resistance value of the writing electrode 3*b* is set at $10^6$ Ωcm or more, the electrostatic breakdown due to pin holes of the charged layer 2*d* of the latent image carrier 2 can be prevented. Therefore, it is preferable that the resistance value of the resistant layer 13 of the writing electrode 3*b* is set in a range from $10^6$ Ωcm to $10^8$ Ωcm.

The writing electrode 3*b* of this example is designed such that the surface of the resistant layer 13 is in plane contact with the charged layer 2*d* of the latent image carrier 2. The function of the resistant layer 13 of the writing electrode 3*b* provided on the conductive pattern 9 prevents the broadening of the charge-transfer in the lateral direction. This achieves effective charge-transfer between the writing electrode 3*b* and the latent image carrier 2. It should be noted that the resistant layer 13 is not limited to be formed to have a rectangular section as shown in FIG. 17(*a*) and thus may be formed in a half-cylindrical configuration having a semi-circular section which projects upwardly in FIG. 17(*a*) and of which axial direction is parallel to the feeding direction. In case of the resistant layer 13 having this half-cylindrical configuration, the resistant layer 13 should be in line contact with the charged layer 2*d* of the latent image carrier 2 along the feeding direction. It should be noted that this line contact may be inclined against the feeding direction.

In the writing device 3 of an example shown in FIG. 17(*b*), the resistant layer 13 of the electrode 3*b* is formed in a semi-circular convex shape projecting upwardly, instead of the shape having a rectangular section of the aforementioned example shown in FIG. 17(*a*). Therefore, the top of the resistant layer 13 is a spherical surface so that the resistant layer 13 is in point contact with the charged layer 2*d* of the latent image carrier 2. According to this structure, charge-transfer is conducted at the point contact portion between the resistant layer 13 and the charged layer 2*d* and charge-transfer due to charge leak is also conducted around the point contact portion, whereby application or removal of charge relative to the charged layer 2*d* can be conducted via the charge-transfer. Since the surface of the resistant layer 13 is spherical, discharge is conducted at location around and near the point contact portion between the resistant layer 13 and the charged layer 2*d*. Therefore, application or removal of charge relative to the charged layer 2*d* can be conducted also via the discharge. Further, this discharge can achieve application or removal of charge relative to the charged layer 2*d* without formation of portions, as mentioned above, in the charged layer 2*d* which are not subjected to the application or removal of charge. Furthermore, because of point contacts foreign matters adhering to the surface of the latent image carrier 2 are allowed to pass, thereby preventing the occurrence of filming on the surface of the latent image carrier 2. Still further, since the resistant layer 13 is made of material easily to wear, the resistant layer 13 is shaved by contact of the surface of the resistant layer 13 of the writing electrodes 3*b* relative to the latent image carrier 2, whereby the resistant layer 13 of the writing electrode 3*b* can have a fresh surface. In this manner, by making the portion of the writing electrode confronting the latent image carrier from material easily to wear, the surface of the writing electrode can be kept fresh, thus preventing the filming.

In the writing device 3 of an example shown in FIG. 17(*c*), a protective layer 14 is formed as an overcoat on the spherical tops of the resistant layers 13 as the example shown in FIG. 17(*b*) and the surface of the substrate 3*a*. This protective layer 14 makes the surfaces of the resistant layers 13 hard to wear and hard to be adhered with foreign matters.

In the writing device 3 of an example shown in FIG. 17(*d*), a large number of microscopic spherical particles 12 are arranged to be freely roll on the surface of the substrate 3*a* supporting the writing electrodes 3*b* with the resistant layers 13 each having a spherical top as the example shown in FIG. 17(*b*), facilitating passing of foreign matters. With the aid of the microscopic particles 12, foreign matters can easily pass between the writing electrodes 3*b* and the latent image carrier 2 and improved lubrication can be obtained between the writing electrodes 3*b* and the foreign matters, thereby preventing adhering of foreign matters to the writing electrodes 3*b*. The particle size of the microscopic particles 12 is normally set to have a diameter widely smaller than the particle diameter of toner (developing powder). Because the particle diameter of toner is normally about 10 $\mu$m, the microscopic particles 12 are set to have a very small diameter of 1 $\mu$m or less. The microscopic particles are made of transparent resin such as acrylic resin. Since the microscopic particles 12 arc made of transparent resin, the microscopic particles 12 never affect the image portions even if the particles 12 move to the image portions.

The microscopic particles 12 are supplied to the substrate 3*a* and the entire surfaces of the writing electrodes 3*b*, only to the writing electrodes 3*b*, or to other locations than the writing electrodes 3*b*. When the microscopic particles 12 are supplied to the entire surfaces, lubricity between the substrate 3*a*, the entire surfaces of the writing electrodes 3*b*, and the latent image carrier 2 is improved. When the microscopic particles 12 are supplied only to the writing electrodes 3*b*, the gap between the writing electrodes 3*b* and the latent image carrier 2 can be kept constant so as to improve the discharge. When the microscopic particles 12 are supplied to other locations than the writing electrodes 3*b*, the charge-transfer is conducted by the writing electrodes 3*b* and lubricity at the locations supplied with the microscopic particles 12 is improved.

Figure 18:
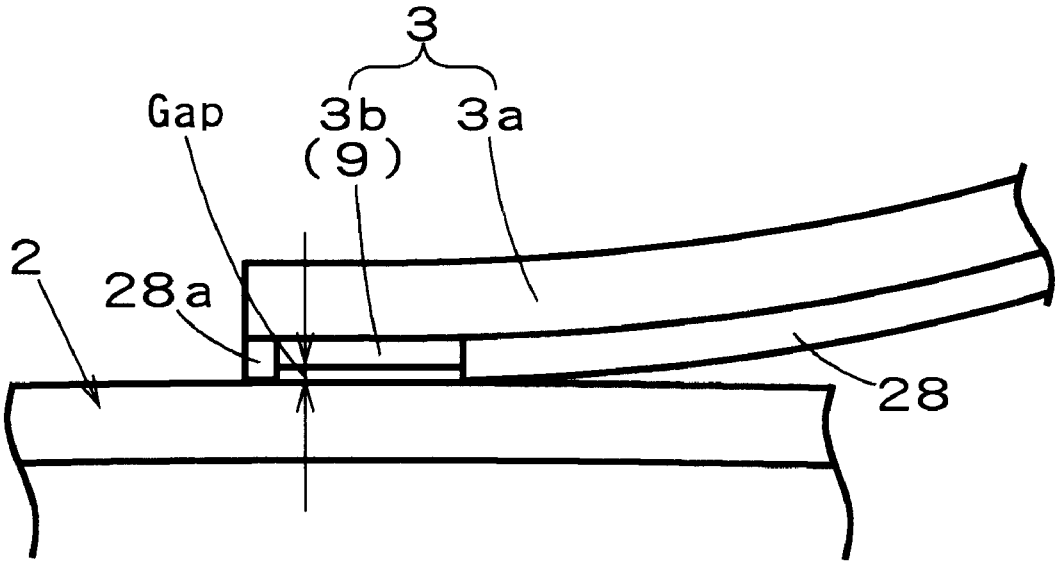
FIG. 18 is a view similar to FIG. 5, but showing another example of the image forming apparatus according to the present invention.

FIG. 18 is a view similar to FIG. 5, but showing another example of the image forming apparatus according to the present invention.

In any of the aforementioned examples, the writing electrodes 3*b* are arranged in contact with the latent image carrier 2. In the image forming apparatus 1 of this example, however, the writing electrodes 3*b* are arranged in proximity to the latent image carrier 2 to have a predetermined gap (slight distance) therebetween so as to occur the discharge relative to the latent image carrier 2. That is, as shown in FIG. 18, the substrate 3*a* is provided with an insulating layer 28 on a surface facing the latent image carrier 2. In this case, the insulating layer 28 is formed in such a manner that the writing electrode 3*b* as an electrode section of the conductive pattern 9 is exposed from the conductive pattern 9 formed on the substrate 3*a*. The thickness of the insulating layer 28 is set to be larger than the thickness of the writing electrode 3*b* by a predetermined value.

The insulating layer 28 is lightly pressed against the latent image carrier 2 by weak elastic restoring force created by deflection of the substrate 3*a* so that the insulating layer 28 is in contact with the latent image carrier 2. Because of the difference in thickness between the insulating layer 28 and the writing electrode 3*b*, the writing electrode 3*b* is arranged in proximity to the latent image carrier 2 to have the predetermined gap (slight distance) therebetween while the insulating layer 28 is in contact with the latent image carrier 2. The slight distance is set, for example, in a range from 30 $\mu$m to 100 $\mu$m. The distance can be adjusted by the thickness of the insulating layer 28. The adjustment of the distance can be made during a process of forming the insulating layer 28. For example, when the insulating layer 28 is formed of an insulating photoresist, the distance can be adjusted during a process of applying the insulating photoresist onto the substrate 3*a*.

Figure 19:
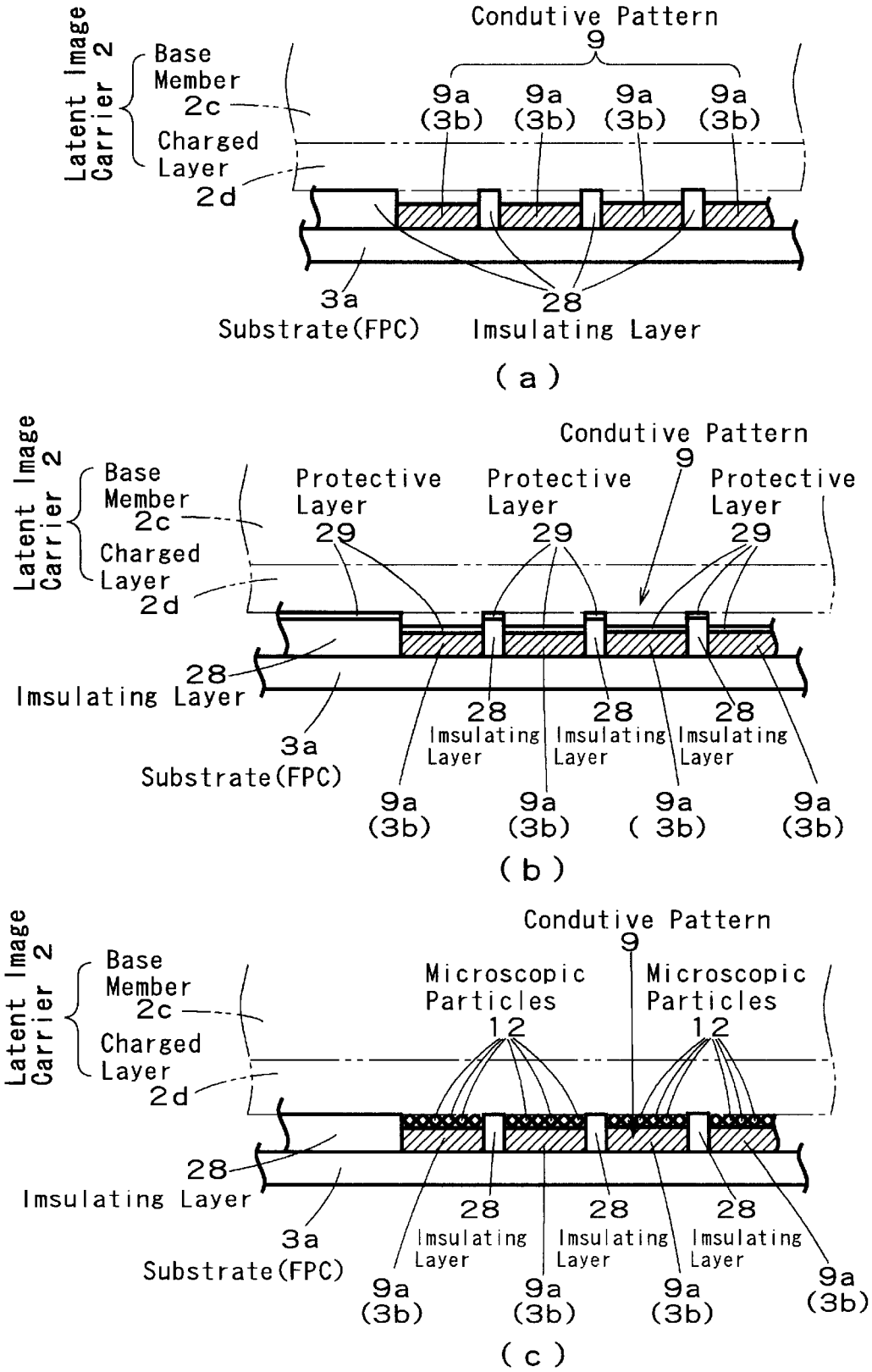
FIG. 19, parts (*a*)–(*c*) are views similar to FIG. 17, but showing examples of the writing device 3 in which the writing electrodes 3*b* are arranged in proximity to the latent image carrier 2, respectively.

FIGS. 19(*a*) through 19(*c*) are views similar to FIG. 17, but showing examples of the writing device 3 in which the writing electrodes 3*b* are arranged in proximity to the latent image carrier 2, respectively. In FIGS. 19(*a*) through 19(*c*), the writing electrodes are illustrated with their contact portions to the latent image carrier 2 facing upward, just like FIG. 17.

In the writing device 3 of an example shown in FIG. 19(*a*), a conductive pattern (Cu pattern) 9 is composed of a predetermined number of foil-shaped conductive material (copper foil) lines 9*a* formed on the substrate 3*a*. Formed at electrode sections of the conductive material lines 9*a* are the writing electrodes 3*b*. Insulating layers 28 are interposed between adjacent conductive material lines 9*a*, respectively and an insulating layer 28 is also provided on the inside of the inner-most conductive material line 9*a*.

In this example, the writing electrodes 3*b* confront with the charged layer 2*d* as planes and are arranged in proximity to the charged layer 2*d* of the latent image carrier 2.

In the writing device 3 of an example shown in FIG. 19(*b*), the conductive material lines 9*a* including the writing electrodes 3*b* and the insulating layers 28 are coated with protective layers 29. The protective layers 29 put on the conductive material lines 9*a* prevent the conductive material lines 9*a* including the writing electrodes 3*b* from rusting due to ozone $o_3$ if any generated. On the other hand, the protective layers 29 put on the insulating layers 28 has lubricity to prevent wear of the insulating layers 28 due to contact with the latent image carrier 2, thereby keeping the predetermined gap (slight distance) between the latent image carrier 2 and the writing electrodes 3*b*.

In the writing device 3 of an example shown in FIG. 19(*c*), a large number of microscopic spherical particles 12 are arranged to be freely roll on the surfaces of the writing electrode 3*b* sections on the conductive pattern 9 of the example shown in FIG. 19(*a*), facilitating passing of foreign matters. The microscopic particles 12 are the same as the microscopic particles 12 shown in FIG. 17(*a*) described above. With the aid of the microscopic particles 12, foreign matters can easily pass between the writing electrodes 3*b* and the latent image carrier 2 and improved lubrication can be obtained between the writing electrodes 3*b* and the foreign matters, thereby preventing adhering of foreign matters to the writing electrodes 3*b*. In addition, with the aid of the microscopic particles 12, the gap between the writing electrodes 3*b* and the latent image carrier 2 can be kept constant. These microscopic particles 12 are made of transparent resin such as acrylic resin to have a very small diameter of 1 $\mu$m or less. Since the microscopic particles 12 are made of transparent resin, the microscopic particles 12 never affect the image portions even if the particles 12 move to the image portions. It should be noted that the microscopic particles may be supplied to the insulating layers 28 so as to improve the lubrication between the insulating layers 28 and the latent image carrier 2.

It should be noted that an insulating layer 28*a*, located at the end of the substrate 3*a* after the writing electrode 3*b*, shown in FIG. 18 can be eliminated.

Figure 20:
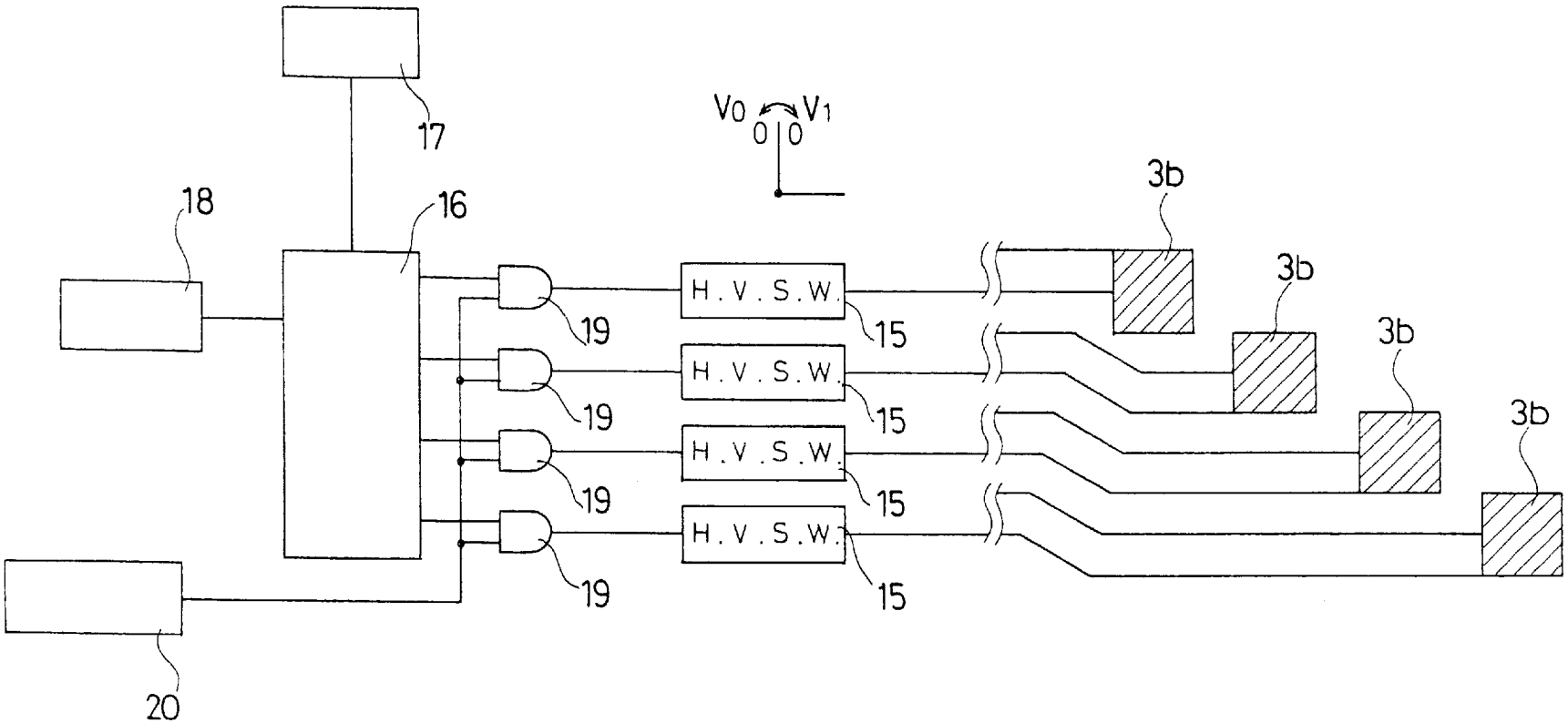
FIG. 20 is a diagram showing a switching circuit for switching the voltage to be supplied to the writing electrodes between the predetermined voltage $V_0$ and the ground voltage $V_1$.

FIG. 20 is a diagram showing a switching circuit for switching the voltage to be connected to the writing electrodes 3*b* between the predetermined voltage $V_0$ and the ground voltage $V_1$.

As shown in FIG. 20, the writing electrodes 3*b* which is arranged, for example, in four lines are connected to corresponding high voltage switches (H.V.S.W.) 15, respectively. Each of the high voltage switches 15 can switch the voltage to be supplied to the corresponding electrode 3*b* between the predetermined voltage $V_0$ and the ground voltage $V_1$. An image writing control signal is inputted into each high voltage switch 15 from a shift resistor (S.R.) 16, to which an image signal stored in a buffer 17 and a clock signal from a clock 18 are inputted. The image writing control signal from the shift resistor is inputted into each high voltage switch 15 through each AND circuit 19 in accordance with a writing timing signal from an encoder 20. The high voltage switches 15 and the AND circuitsl9 cooperate together to form the aforementioned driver 11 which controls the supply voltage for the corresponding electrodes 3*b*.

Figure 21:
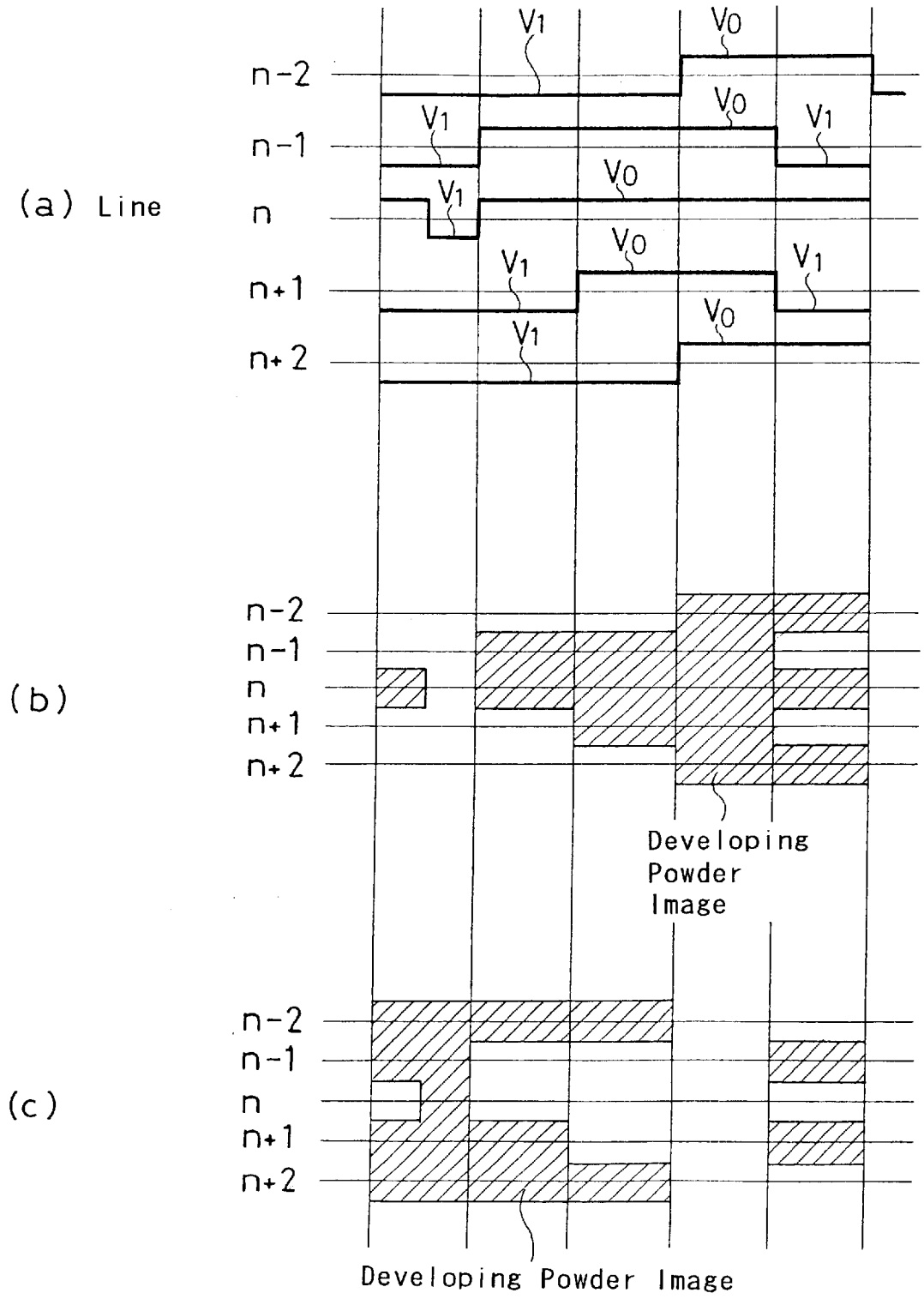
FIG. 21, parts (*a*)–(*c*) show profiles when the supply voltage for each electrode is selectively controlled into the predetermined voltage $V_0$ or the ground voltage $V_1$ by switching operation of the corresponding high voltage switch, wherein part (*a*) is a diagram showing the voltage profiles of the respective electrodes, part (*b*) is a diagram showing a developing powder image obtained by normal developing with the voltage profiles shown in part (*a*), and part (*c*) is a diagram showing a developing powder image obtained by reverse developing with the voltage profiles shown in part (*a*)

FIGS. 21(*a*)–21(*c*) show profiles when the supply voltage for each electrode 3*b* is selectively controlled into the predetermined voltage $V_0$ or the ground voltage $V_1$ by switching operation of the corresponding high voltage switch 15, wherein FIG. 21(*a*) is a diagram showing the voltage profiles of the respective electrodes, FIG. 21(*b*) is a diagram showing a developing powder image obtained by normal developing with the voltage profiles shown in FIG. 21(*a*), and FIG. 21(*c*) is a diagram showing a developing powder image obtained by reverse developing with the voltage profiles shown in FIG. 21(*a*).

Assuming that the electrodes 3*b*, for example as shown in FIGS. 21(*a*)–21(*c*), five electrodes indicated by n−2, n−1, n, n+1, and n+2, respectively, are controlled to be into the voltage profiles shown in FIG. 21(*a*) by switching operation of the respective high voltage switches 15. When an electrostatic latent image is written on the latent image carrier 2 with the electrodes 3*b* having the aforementioned voltage profiles and is then developed normally, the developing powder 8 adheres to portions at the predetermined voltage $V_0$ of the latent image carrier 2, thereby obtaining a developing powder image as shown by hatched portions in FIG. 21(*b*). When an electrostatic latent image is written in the same manner and is then developed reversely, the developing powder 8 adheres to portions at the ground voltage $V_1$ of the latent image carrier 2, thereby obtaining a developing powder image as shown by hatched portions in FIG. 21(*c*).

According to the image forming apparatus 1 employing the writing device 3 having the aforementioned structure, the plurality of writing electrodes 3*b* are aligned in the main scanning direction of the latent image carrier 2, thereby making the array pattern (electrode pattern) simple and ensuring an image formation region.

In addition, the writing electrodes 3*b* are supported by the flexible substrate 3*a*, thereby stabilizing the positions of the writing electrodes 3*b* relative to the latent image carrier 2 and thus stably and reliably conducting the application or removal of charge by the writing electrodes 3*b* relative to the latent image carrier 2. Therefore, stable writing of an electrostatic latent image is achieved, thus reliably obtaining a high quality image with high precision.

Further, every pair of writing electrodes 3*b* which are next to each other are partially overlapped with each other as seen in the feeding direction of the latent image carrier 2, thereby eliminating such portions in the surface of the latent image carrier 2 that are not subjected to the application or removal of charge and thus achieving uniform application or removal of charge relative to the entire surface of the latent image carrier 2. Therefore, the occurrence of image defect due to linear stains can be prevented.

Furthermore, corners of a polygon of each writing electrode 3*b* are rounded off to eliminate sharp angled portions (edges), thereby preventing the discharge between adjacent writing electrodes.

Since the writing electrodes 3*b* can be securely kept in contact with the latent image carrier with a small pressing force by the flexible substrate 3*a* or securely kept in proximity to the latent image carrier 2, the gap (space) between the writing electrodes 3*b* and the latent image carrier 2 can be extremely reduced. The reduced gap practically reduces the possibility that air existing in the gap is undesirably ionized, thereby further reducing the generation of ozone and enabling the formation of an electrostatic latent image with low potential. In addition, the latent image carrier 2 can be prevented from being damaged by the writing electrodes, thus improving the durability of the latent image carrier 2.

Since the writing electrodes 3*b* are in contact with the latent image carrier 2 by a small pressing force, the latent image carrier 2 can be prevented from being damaged by the writing electrodes 3*b*, thus improving the durability of the latent image carrier 2.

Further, since the writing device 3 employs only the writing electrodes 3*b* without using a laser beam generating device or a LED light generating device which is large in size as conventionally used, the apparatus size can be reduced and the number of parts can also be reduced, thereby obtaining an image forming apparatus which is simple and low-price.

Moreover, the substrate 3*a* and the writing electrodes 3*b* are coated with the protective layers 14, 29. The protective layers 14, 29 prevent wear of the writing electrodes 3*b* and prevent foreign matters from adhering to the writing electrodes 3*b*. It should be noted that, according to the present invention, it is not necessary to coat both of the substrate 3*a* and the writing electrodes 3*b* with the protective layers 14, 29 and it is enough to coat at least the writing electrodes 3*b* with the protective layers 14, 29.

Figure 22:
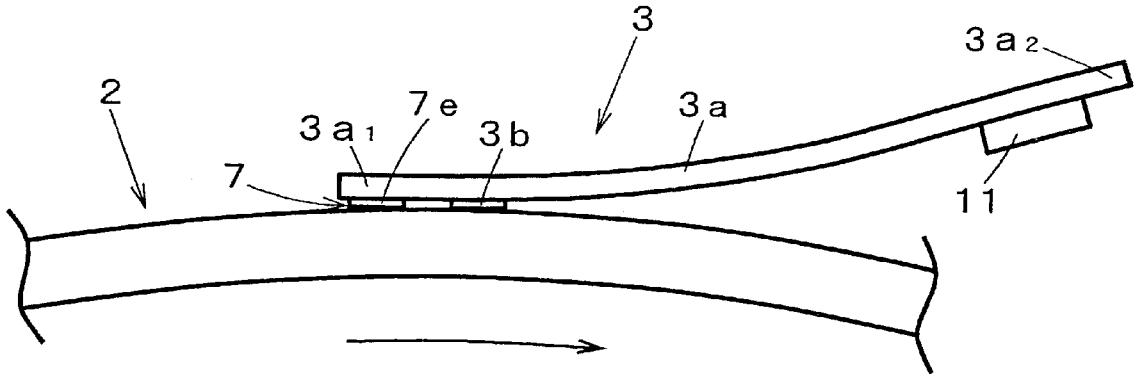
FIG. 22 is a view similar to FIG. 5 but schematically and partially showing another example of the image forming apparatus according to the present invention.

FIG. 22 is a view similar to FIG. 5 but schematically and partially showing another example of the image forming apparatus according to the present invention.

In any of the aforementioned examples, the charge control device 7 for uniformly charging the latent image carrier 2 is provided separately from the writing device 3. In the image forming apparatus 1 of this example, the charge control device 7 is disposed on the substrate 3*a* of the writing device 3 as well as the writing electrodes 3*a*. That is, a uniformly charging electrode 7*e* of the charge control device 7 is disposed on the end $3a_1$ of the substrate 3*a* of the writing device 3 in such a manner that the writing electrodes 3*b* are spaced apart from the uniformly charging electrode 7*e* at a predetermined gap. In this case, the uniformly charging electrode 7*e* is formed into a thin plate-like shape having a rectangular section. The uniformly charging electrode 7*e* is continuously disposed to extend in the axial direction of the latent image carrier 2 along the same length as the axial length of the charged layer 2*d* of the latent image carrier 2. The writing electrodes 3*b* and the uniformly charging electrode 7 are kept in contact with the surface of the latent image carrier 2 with a small pressing force by weak elastic restoring force created by deflection of the substrate 3*a*.

In the image forming apparatus 1 of this example having the aforementioned structure, after the surface of the latent image carrier 2 is uniformly charged by the uniformly charging electrode 7*e* on the end $3a_1$ of the substrate 3*a*, the writing electrodes 3*b* write an electrostatic latent image on the surface of the latent image carrier 2 by applying charge to or removing charge from selected areas of the surface of the latent image carrier 2 through discharge of the writing electrodes 3*b*.

In the image forming apparatus of this example, the uniformly charging electrode 7*e* and the writing electrodes 3*b* are disposed together, thereby allowing the manufacture of an image forming apparatus 1 which is smaller in size and simpler in structure. The other structures, actions, and effects of the image forming apparatus 1 of this example are the same as those of the example shown in FIG. 5.

It should be understood that the design of providing the uniformly charging electrode 7*e* and the writing electrodes 3*b* as one unit is not limited to the illustrated example shown in FIG. 22, may be applied to any of the image forming apparatuses of the aforementioned examples and, in addition, any case applied with this design can exhibit the same works and effects. A suitable insulator may be arranged in the gap between the writing electrodes 3*b* and the uniformly charging electrode 7*e*.

As apparent from the aforementioned description, in the image forming apparatus of the present invention, a plurality of writing electrodes are aligned in the main scanning direction of a latent image carrier, thereby making a simple array pattern (electrode pattern) and ensuring an image formation region.

In addition, the writing electrodes are supported by a flexible substrate, thereby stabilizing the positions of the writing electrodes relative to the latent image carrier and thus stably and reliably conducting the application or removal of charge by the writing electrodes relative to the latent image carrier. Therefore, stable writing of an electrostatic latent image is achieved, thus reliably obtaining a high quality image with high precision.

Since the writing electrodes can be securely kept in contact with the latent image carrier with a small pressing force by the flexible substrate or securely kept in proximity to the latent image carrier, the gap (space) between the writing electrodes and the latent image carrier can be extremely reduced. The reduced gap practically reduces the possibility that air existing in the gap is undesirably ionized, thereby further reducing the generation of ozone and enabling the formation of an electrostatic latent image with low potential. In addition, the latent image carrier can be prevented from being damaged by the writing electrodes, thus improving the durability of the latent image carrier.

Further, since the writing device employs only the writing electrodes without using a laser beam generating device or a LED light generating device which is large in size as conventionally used, the apparatus size can-be reduced and the number of parts can also be reduced, thereby obtaining an image forming apparatus which is simple and low-price.

The writing electrodes which aligned just in a single row extending in the main scanning direction, thereby making a simple array pattern (electrode pattern) and ensuring an image formation region.

Further, every pair of adjacent writing electrodes which are next to each other are partially overlapped with each other as seen in the feeding direction of the latent image carrier, thereby eliminating such portions in the surface of the latent image carrier that are not subjected to the application or removal of charge and thus achieving uniform application or removal of charge relative to the entire surface of the latent image carrier. Therefore, the occurrence of image defect due to linear stains can be prevented.

The writing electrodes are each formed in a triangle, a parallelogram, or a trapezoid, thereby allowing foreign matters adhering to the surface of the latent image carrier to smoothly and easily pass through spaces between adjacent writing electrodes because the foreign matters can be guided by oblique sides of the triangles, parallelograms, or trapezoids.

Further, the triangular or trapezoidal writing electrodes are arranged in such a manner that the orientations of the triangles or trapezoids of the writing electrodes are alternately inverted. This arrangement enables the triangular or trapezoidal writing electrodes to be efficiently aligned in a compact form in the main scanning direction. This arrangement of alternately inverting the orientations of the triangular or trapezoidal writing electrodes ensures the adjacent writing electrodes to be efficiently partially overlapped with each other as seen in the feeding direction, thereby efficiently and securely exhibiting the effect of overlapping mentioned above.

Furthermore, since the writing electrode can be formed in a circle an oval, an ellipse, a rectangle, a square, a pentagon, a polygon having 6 or more corners, or a polygon with rounded corners, the writing electrode is flexible to be employed in various types of image forming apparatuses using writing electrodes. In particular, by rounding off corners of a polygon of the writing electrode to eliminate sharp angled portions (edges), the discharge between adjacent writing electrodes can be prevented.

The writing electrodes are aligned in a plurality of parallel rows each extending in the main scanning direction, thereby ensuring the adjacent writing electrodes to be efficiently partially overlapped with each other as seen in the feeding direction, thereby efficiently and securely exhibiting the effect of overlapping mentioned above. In particular, according to the invention defined in claim 8, the writing electrodes are aligned in two parallel rows extending in the axial direction, thus making the arrangement of the writing electrodes more simple and easily arranging the writing electrodes while overlapping portions thereof.

Moreover, at least the writing electrodes are coated with the protective layers. The protective layers prevent wear of the writing electrodes and prevent foreign matters from adhering to the writing electrodes.

In addition, since the portion of the writing electrode confronting the latent image carrier is made of material easily to wear, the surface of the writing electrode should wear to have a fresh surface so that the surface of the writing electrode can be kept fresh, thus preventing the filming of the writing electrode.

What we claim is:

1. An image forming apparatus comprising at least: a latent image carrier on which an electrostatic latent image is formed, a writing device for writing said electrostatic latent image on said latent image carrier, and a developing device for developing said electrostatic latent image on the latent image carrier, wherein said electrostatic latent image, written on said latent image carrier by said writing device, is developed by said developing device, thereby forming an image, said image forming apparatus being characterized in that said writing device has a plurality of writing electrodes for writing said electrostatic latent image on said latent image carrier and a substrate for supporting said writing electrodes, and that said plurality of writing electrodes are aligned in the main scanning direction of said latent image carrier, and that said plurality of writing electrodes are aligned in a single row extending in the main scanning direction of said latent image carrier, and that said plurality of writing electrodes are arranged such that a portion of one writing electrode is overlapped with a portion of a writing electrode, next to said one writing electrode, as seen in the feeding direction of said latent image carrier.

2. An image forming apparatus comprising at least: a latent image carrier on which an electrostatic latent image is formed, a writing device for writing said electrostatic latent image on said latent image carrier, and a developing device for developing said electrostatic latent image on the latent image carrier, wherein said electrostatic latent image, written on said latent image carrier by said writing device, is developed by said developing device, thereby forming an image, said image forming apparatus being characterized in that said writing device has a plurality of writing electrodes for writing said electrostatic latent image on said latent image carrier and a substrate for supporting said writing electrodes, and that said plurality of writing electrodes are aligned in the main scanning direction of said latent image carrier, and that said plurality of writing electrodes are aligned in a single row extending in the main scanning direction of said latent image carrier, and that said plurality of writing electrodes are each formed in a triangle, a parallelogram, or a trapezoid.

3. An image forming apparatus as claimed in claim 2, being characterized in that said plurality of writing electrodes are aligned in a plurality of rows each extending in the main scanning direction of said latent image carrier, wherein the rows are arranged in parallel with each other in the feeding direction of said latent image carrier.

4. An image forming apparatus as claimed in claim 3, being characterized in that the number of the parallel rows extending in the main scanning direction is two and said writing electrodes are arranged in zigzag fashion such that a writing electrode in one row is placed at a position corresponding to a position between two adjacent writing electrodes in the other row while a writing electrode in the other row is placed at a position corresponding to a position between two adjacent writing electrodes in said one row.

5. An image forming apparatus comprising at least: a latent image carrier on which an electrostatic latent image is formed, a writing device for writing said electrostatic latent image on said latent image carrier, and a developing device for developing said electrostatic latent image on the latent image carrier, wherein said electrostatic latent image, written on said latent image carrier by said writing device, is developed by said developing device, thereby forming an image, said image forming apparatus being characterized in that said writing device has a plurality of writing electrodes for writing said electrostatic latent image on said latent image carrier and a substrate for supporting said writing electrodes, and that said plurality of writing electrodes are aligned in the main scanning direction of said latent image carrier, and that said plurality of writing electrodes are aligned in a single row extending in the main scanning direction of said latent image carrier, and that said plurality of writing electrodes are each formed in a triangle or a trapezoid and the writing electrodes are arranged in such a manner that the orientations of the triangles or trapezoids of the writing electrodes are alternately inverted.

6. An image forming apparatus comprising at least: a latent image carrier on which an electrostatic latent image is formed, a writing device for writing said electrostatic latent image on said latent image carrier, and a developing device for developing said electrostatic latent image on the latent image carrier, wherein said electrostatic latent image, written on said latent image carrier by said writing device, is developed by said developing device, thereby forming an image, said image forming apparatus being characterized in that said writing device has a plurality of writing electrodes for writing said electrostatic latent image on said latent image carrier and a substrate for supporting said writing electrodes, and that said plurality of writing electrodes are aligned in the main scanning direction of said latent image carrier, and that said plurality of writing electrodes are aligned in a single row extending in the main scanning direction of said latent image carrier, and that said plurality of writing electrodes are each formed in, an oval, an ellipse, a square, a pentagon, a polygon having 6 or more corners, or a polygon with rounded corners.

7. An image forming apparatus as claimed in any one of claims 1 through 6, being characterized in that at least said writing electrodes are coated with protecting layers.

8. An image forming apparatus as claimed in any one of claims 1 through 6, being characterized in that at least a portion of each said writing electrode confronting said latent image carrier is made of material easily to wear.

9. An image forming apparatus comprising at least:

a latent image carrier on which an electrostatic latent image is formed; and a writing device comprising a plurality of writing electrodes to write said electrostatic latent image on said latent image carrier, said plurality of writing electrodes substantially aligned in at least one row in the axial direction of said latent image carrier and arranged such that a portion of one writing electrode is overlapped with a portion of a next writing electrode as seen in the feeding direction of said latent image carrier, and a substrate for supporting said writing electrodes.

10. The image forming apparatus of claim 9, wherein said plurality of writing electrodes are aligned in a plurality of rows each extending in the axial direction of said latent image carrier, such that said rows are arranged in parallel with each other in the feeding direction of said latent image carrier.

11. The image forming apparatus of claim 9, wherein the number of parallel rows extending in the axial direction of said latent image carrier is two and said writing electrodes are arranged in a zigzag fashion such a that a writing electrode in one row is placed at a position corresponding to a position between two adjacent writing electrodes in a second row.

12. The image forming apparatus of claim 9, wherein the writing electrodes are substantially triangular, parallelogram, or trapezoid in shape and arranged in such manner that the orientations of adjacent substantially triangular, parallelogram, or trapezoid writing electrodes are alternately inverted.

* * * * *